US008802423B2

(12) United States Patent
Lai et al.

(10) Patent No.: US 8,802,423 B2
(45) Date of Patent: Aug. 12, 2014

(54) METHOD FOR TREATING TEXTILE WITH ENDOGLUCANASE

(75) Inventors: Weijian Lai, Beijing (CN); Guifang Wu, Beijing (CN); Ye Liu, Beijing (CN); Yucheng Zhou, Beijing (CN); Yang Han, Beijing (CN)

(73) Assignee: Novozymes A/S, Bagsvaerd (DK)

( * ) Notice: Subject to any disclaimer, the term of this patent is extended or adjusted under 35 U.S.C. 154(b) by 0 days.

(21) Appl. No.: 13/997,774

(22) PCT Filed: Dec. 14, 2011

(86) PCT No.: PCT/CN2011/084002

§ 371 (c)(1),
(2), (4) Date: Jul. 25, 2013

(87) PCT Pub. No.: WO2012/089024

PCT Pub. Date: Jul. 5, 2012

(65) Prior Publication Data

US 2013/0295651 A1 Nov. 7, 2013

Related U.S. Application Data

(60) Provisional application No. 61/435,447, filed on Jan. 24, 2011.

(30) Foreign Application Priority Data

Dec. 30, 2010 (WO) ..... PCT/CN2010/080535

(51) Int. Cl.
*D06M 16/00* (2006.01)

(52) U.S. Cl.
CPC ..... *D06M 16/003* (2013.01)
USPC ..... 435/263; 435/277; 435/274; 435/267; 435/209

(58) Field of Classification Search
None
See application file for complete search history.

(56) References Cited

U.S. PATENT DOCUMENTS

| | | | | | |
|---|---|---|---|---|---|
| 5,443,750 | A * | 8/1995 | Convents et al. | ..... | 510/322 |
| 5,457,046 | A * | 10/1995 | Woldike et al. | ..... | 435/209 |
| 5,948,672 | A * | 9/1999 | Rasmussen et al. | ..... | 435/264 |
| 5,958,082 | A * | 9/1999 | Lund et al. | ..... | 8/102 |
| 6,001,639 | A * | 12/1999 | Schulein et al. | ..... | 435/263 |
| 6,083,739 | A * | 7/2000 | Franks | ..... | 435/263 |
| 7,256,032 | B2 * | 8/2007 | Valtakari et al. | ..... | 435/209 |
| 2008/0145912 | A1 * | 6/2008 | Schulein et al. | ..... | 435/197 |
| 2009/0170747 | A1 * | 7/2009 | Andersen et al. | ..... | 510/392 |
| 2010/0107342 | A1 | 5/2010 | Schulein et al. | | |
| 2011/0271464 | A1 * | 11/2011 | Kuilderd et al. | ..... | 8/401 |

FOREIGN PATENT DOCUMENTS

| | | | |
|---|---|---|---|
| EP | 0 843 041 | A1 | 5/1998 |
| EP | 1 726 644 | A1 | 11/2006 |
| WO | 91/17243 | A1 | 11/1991 |
| WO | 94/21801 | A2 | 9/1994 |

(Continued)

OTHER PUBLICATIONS

Bhat et al., Biotechnology Advances, vol. 18, pp. 355-383 (2000).

*Primary Examiner* — Rebecca Prouty
*Assistant Examiner* — Richard Ekstrom
(74) *Attorney, Agent, or Firm* — Elias Lambiris

(57) ABSTRACT

The present invention relates to the method for manufacturing textile, by treating textile with an isolated polypeptide having endoglucanase activity, especially in biostoning and bio-polishing process.

20 Claims, 2 Drawing Sheets

(56) References Cited

FOREIGN PATENT DOCUMENTS

| | | | | |
|---|---|---|---|---|
| WO | 95/09225 | A1 | | 4/1995 |
| WO | 95/16782 | A1 | | 6/1995 |
| WO | 97/09410 | A1 | | 3/1997 |
| WO | WO 9812307 | A1 | * | 3/1998 |
| WO | 01/92453 | A1 | | 12/2001 |
| WO | 2004/053039 | A2 | | 6/2004 |
| WO | WO 2009010444 | A2 | * | 1/2009 |
| WO | 2009/103237 | A1 | | 8/2009 |
| WO | WO 2011153516 | A2 | * | 12/2011 |
| WO | WO 2012106824 | A1 | * | 8/2012 |

* cited by examiner

METHOD FOR TREATING TEXTILE WITH ENDOGLUCANASE

CROSS-REFERENCE TO RELATED APPLICATIONS

This application is a 35 U.S.C. 371 national application of PCT/CN2011/084002 filed Dec. 14, 2011 which claims priority or the benefit under 35 U.S.C. 119 of Chinese PCT application no. PCT/CN2010/080535 filed Dec. 30, 2010 and U.S. provisional application No. 61/435,447 filed Jan. 24, 2011, the contents of which are fully incorporated herein by reference.

REFERENCE TO SEQUENCE LISTING

This application contains a Sequence Listing in computer readable form. The computer Readable form is incorporated herein by reference.

FIELD OF THE INVENTION

The present invention relates to the method for manufacturing textile, by treating textile with an isolated polypeptide having endoglucanase activity, especially in biostoning and biopolishing process.

BACKGROUND OF THE INVENTION

There is a wide spectrum of industrial applications of cellulases. In the textile industry, cellulases are used in denim finishing to create a fashionable stone washed appearance on denim cloths using a biostoning process. Cellulases are also used, for instance, to clean fuzz and prevent formation of pills on the surface of cotton garments using a biopolishing process.

A general problem associated with enzymatic stone washing is the backstaining caused by redeposition of removed Indigo dye during or after abrasion. The "backstaining" or "redeposition" of Indigo dye reduces the desired contrast between the white and indigo dyed yarns and it can be most easily distinguished on the reverse side of denim and the interior pockets (as increased blueness). On the face side of the denim this may be seen as reduced contrast between dyed areas and areas from which dye has been removed during biostoning. In order to remove the redeposited dye, the denim manufacturers use large amounts of surfactants to make the redeposited parts white again for example to increase the contrast between abraded parts and non abraded parts of the denim in a soaping process. The heavy wash condition causes colour change or colour-fading problems for finished denim products. Also additional water has to be used in the subsequent soaping process. The problem of redeposition or backstaining of dye during stonewashing has also been addressed by adding anti-redeposition chemicals, such as surfactants or other agents into the cellulase wash.

WO 97/09410 describes that the addition of a certain type of cellulase to another cellulase having abrading activity reduces backstaining. The additional cellulase belongs to glycosyl hydrolase family 5 or 7, but it has no significant abrading effect by itself. WO 01/92453 discloses backstaining reduction by treating textile with a cutinase.

It is rare for a single endoglucanase to both provide high abrasion of denim and control indigo backstain to an acceptable level. WO 91/17243 and WO 95/09225 describe a process using a single-component endoglucanase denoted EGV with a molecular weight of 43 kD derived from *Humicola insolens* strain DSM 1800. WO 94/21801 describes the use in "stone washing" of a single-component endoglucanase called EGIII derived from *Trichoderma longibrachiatum*. WO 95/16782 suggests the use of other single-component endoglucanases derived from *Trichoderma* in "stone washing". WO 2009/103237 discloses the use of an endoglucanase derived from *Aspergillus fumigates* in "stone washing".

There are continued needs in the art for new endoglucanases and methods for obtaining a cellulosic textile fabric with good abrasion effect but low backstaining level, especially at low temperature.

Biopolishing is a specific treatment of the yarn surface which improves fabric quality with respect to handle and appearance. The most important effects of biopolishing can be characterized by less fuzz and pilling, increased gloss/luster, improved fabric handle, increased durable softness and/or improved water absorbency. Biopolishing usually takes place in the wet processing of the manufacture of knitted and woven fabrics. Wet processing comprises such steps as e.g. desizing, scouring, bleaching, washing, dying/printing and finishing.

There are still needs in the art for new endoglucanases and methods for obtaining a cellulosic textile fabric with strongly reduced tendency to pilling formation but without substantial weight loss of the fabric in the biopolishing process, especially at low temperature. During textile processing like desizing, scouring and soaping, surfactant especially anionic surfactant is widely used. So, there will be some amount of surfactant remaining in the fabric during biopolishing process. It is very important that the endoglucanases have good compatibility with surfactant while reaching the same level of biopolishing effect.

The present invention aims to meet these needs.

SUMMARY OF THE INVENTION

The present invention relates to a method for treating textile, by treating textile with an isolated polypeptide which has endoglucanase activity but does not comprise a functional CBM, selected from the group consisting of:

(a) a polypeptide having at least 80% sequence identity to the mature polypeptide of SEQ ID NO: 2;

(b) a polypeptide encoded by a polynucleotide that hybridizes under medium stringency conditions, with (i) the mature polypeptide coding sequence of SEQ ID NO: 1, or (ii) the cDNA sequence contained in the mature polypeptide coding sequence of SEQ ID NO: 1, or (iii) the full-length complementary strand of (i) or (ii);

(c) a polypeptide encoded by a polynucleotide having at least 80% sequence identity to the mature polypeptide coding sequence of SEQ ID NO: 1; or (d) a polypeptide comprising a substitution, deletion, and/or insertion of one or more (several) amino acids of the mature polypeptide of SEQ ID NO: 2.

In one embodiment, the method may be applied to a biostoning process to form localized variation of color density in the surface of a dyed cellulosic or cellulose-containing textile. Preferably, the dyed cellulosic or cellulose-containing fabric is a denim fabric, more preferably indigo dyed denim fabric. Preferably, the biostoning process shows abrasion effect of at least 0.5 Delta L* unit, preferably at least 1, more preferably 1.5, and more preferably 2 and even more preferably 2.5 Delta L* unit.

In some embodiments, the biostoning process may further comprise one or more enzymes selected from the group consisting of proteases, lipases, cutinases, amylases, pectinases, hemicellulases and cellulases.

In some embodiments, the method may be applied to a biopolishing process. Preferably, the biopolishing process shows pilling note of at least 3, more preferably at least 3.4, more preferably at least 3.8, and most preferably at least 4. More preferably, the biopolishing process further shows weight loss of less than 10%, preferably less than 5%, more preferably less than 4%, more preferably less than 3.5%, and most preferably less than 3%.

In some embodiments, the method for manufacturing textile is provided. In some embodiments, the textile is manufactured from fabric to garment.

In some embodiments, the textile is cellulose-containing or cellulosic textile. In some embodiments, the textile is denim.

In textile manufacturing, the polypeptide of the present invention when used alone, i.e. without other enzymes, especially without other cellulases, can provide both increased abrasion effect and low backstaining level during a biostoning process. The method of the present invention can obtain a cellulosic textile fabric with strongly reduced pilling formation but without substantial weight loss of fabric in a biopolishing process, especially in the presence of surfactant. The further advantage of the present invention is that the method can be conducted in low temperature, such as below 50° C., so as to save energy in textile manufacturing process.

DETAILED DESCRIPTION OF THE INVENTION

Figure 1:
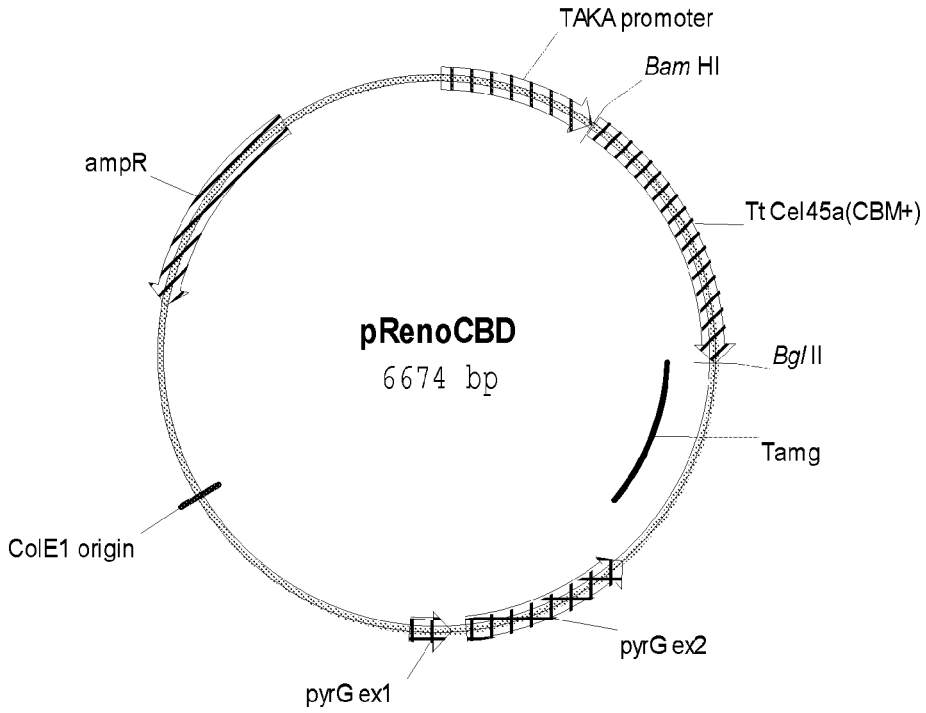
FIG. 1 shows a restriction map of pRenoCBD.

The invention will now be described in detail by way of reference using the following definitions and examples. All patents and publications, including all sequences disclosed within such patents and publications, referred to herein are expressly incorporated by reference.

As used herein, the singular terms "a", "an," and "the" include the plural reference unless the context clearly indicates otherwise.

Definitions

Endoglucanase: The term "endoglucanase" means an endo-1,4-(1,3;1,4)-beta-D-glucan 4-glucanohydrolase (E.C. 3.2.1.4), which catalyzes endohydrolysis of 1,4-beta-D-glycosidic linkages in cellulose, cellulose derivatives (such as carboxymethyl cellulose and hydroxyethyl cellulose), lichenin, beta-1,4 bonds in mixed beta-1,3 glucans such as cereal beta-D-glucans or xyloglucans, and other plant material containing cellulosic components. Endoglucanase activity can be determined by measuring reduction in substrate viscosity or increase in reducing ends determined by a reducing sugar assay (Zhang et al., 2006, *Biotechnology Advances* 24: 452-481). For purposes of the present invention, endoglucanase activity is determined using carboxymethyl cellulose (CMC) as substrate according to the procedure of part VI in page 264 of Ghose, 1987, *Pure and Appl. Chem.* 59: 257-268.

Typically, the endoglucanase has at least two functional domains, a carbohydrate-binding module (CBM) and a catalytic module. The catalytic module is defined as an amino acid sequence that is capable of enzymatically cleaving cellulose, e.g. has endoglucanase activity. The catalytic module is not considered to be a carbohydrate-binding module. A "linker sequence" connects the two functional modules.

Carbohydrate-binding module: The term "carbohydrate-binding module" (CBM) is defined as an amino acid sequence that binds to a substrate. CBMs are for example described in Boraston et al, Biochem. J. (2004) 382, 769-781 and in Tomme et al., John N. Saddler and Michael H. Penner (Eds.), ACS Symposium Series, No. 618, 1995. It is believed that the CBM binding to the substrate which increases the efficacy of the catalytic active part of the enzyme.

The term CBM is now in general use; however, the term "cellulose-binding domain" (CBD) is used to describe the subset of CBM that bind specifically to cellulose substrate. In context, CBM or CBD of the polypeptide having endoglucanase activity could be used interchangeably.

Binding activity can be determined, for example, by binding to microcrystalline cellulose such as Avicel and showing that the putative binding module is removed from solution.

In the present invention, a polypeptide having endoglucanase activity but lacking a functional CBM can either lack a CBM sequence entirely, or may contain a residue CBM sequence that has been modified to destroy its cellulose-binding activity, by deletion, addition, and/or substitution of one or more amino acid residues or by any chemical or enzymatic modification of the intact protein; such a modified sequence is also referred to as a polypeptide having endoglucanase activity with a non-functional CBM.

For the purpose of the present invention, a polypeptide having endoglucanase activity but lacking a functional CBM can be identified using, for example, the method describe in Example 6 below, which involves incubation of the enzyme with cellulose substrate Avicel to allow binding, followed by centrifugation and detection of the protein content in the supernant. Typically, a polypeptide having endoglucanase activity but lacking a functional CBM has a low affinity for Avicel in the assay, which leads to high protein content remained in the supernant. In the present invention, a polypeptide having endoglucanase activity but lacking a functional CBM shows no more than 15% absorption, more preferably no more than 14% absorption, more preferably no more than 13% absorption, more preferably no more than 12% absorption, more preferably no more than 11% absorption, even more preferably no more than 10% absorption as defined in Example 6.

In some embodiments, a polypeptide having endoglucanase activity but lacking a CBM sequence entirely can be a native (wild-type) endoglucanase.

In some embodiments, a polypeptide having endoglucanase activity but lacking a functional CBM is a polypeptide having endoglucanase activity with CBM truncated by any of a variety of techniques, including biochemical or genetic engineering techniques.

Isolated polypeptide: The terms "isolated" and "purified" mean a polypeptide or polynucleotide that is removed from at least one component with which it is naturally associated. For example, a polypeptide may be at least 1% pure, e.g., at least 5% pure, at least 10% pure, at least 20% pure, at least 40% pure, at least 60% pure, at least 80% pure, and at least 90% pure, as determined by SDS-PAGE and a polynucleotide may be at least 1% pure, e.g., at least 5% pure, at least 10% pure, at least 20% pure, at least 40% pure, at least 60% pure, at least 80% pure, at least 90% pure, and at least 95% pure, as determined by agarose electrophoresis.

Mature polypeptide: The term "mature polypeptide" means a polypeptide in its final form following translation and any post-translational modifications, such as N-terminal processing, C-terminal truncation, glycosylation, phosphorylation, etc. In one aspect, the mature polypeptide is amino acids 22 to 237 of SEQ ID NO: 2 and amino acids 1 to 21 of SEQ ID NO: 2 are a signal peptide based on the program SignalP (Nielsen et al., 1997, *Protein Engineering* 10: 1-6).

Mature polypeptide coding sequence: The term "mature polypeptide coding sequence" means a polynucleotide that encodes a mature polypeptide having endoglucanase activity. In one aspect, the mature polypeptide coding sequence is nucleotides 64 to 858 of SEQ ID NO: 1 and nucleotides 1 to 63 of SEQ ID NO: 1 encode a signal peptide based on the program SignalP (Nielsen et al., 1997, *Protein Engineering* 10: 1-6).

Sequence Identity: The relatedness between two amino acid sequences or between two nucleotide sequences is described by the parameter "sequence identity".

For purposes of the present invention, the degree of sequence identity between two amino acid sequences is determined using the Needleman-Wunsch algorithm (Needleman and Wunsch, 1970, *J. Mol. Biol.* 48: 443-453) as implemented in the Needle program of the EMBOSS package (EMBOSS: The European Molecular Biology Open Software Suite, Rice et al., 2000, *Trends Genet.* 16: 276-277), preferably version 3.0.0 or later. The optional parameters used are gap open penalty of 10, gap extension penalty of 0.5, and the EBLOSUM62 (EMBOSS version of BLOSUM62) substitution matrix. The output of Needle labeled "longest identity" (obtained using the -nobrief option) is used as the percent identity and is calculated as follows:

(Identical Residues×100)/(Length of Alignment−Total Number of Gaps in Alignment)

For purposes of the present invention, the degree of sequence identity between two deoxyribonucleotide sequences is determined using the Needleman-Wunsch algorithm (Needleman and Wunsch, 1970, supra) as implemented in the Needle program of the EMBOSS package (EMBOSS: The European Molecular Biology Open Software Suite, Rice et ai, 2000, supra), preferably version 3.0.0 or later. The optional parameters used are gap open penalty of 10, gap extension penalty of 0.5, and the EDNAFULL (EMBOSS version of NCBI NUC4.4) substitution matrix. The output of Needle labeled "longest identity" (obtained using the -nobrief option) is used as the percent identity and is calculated as follows:

(Identical Deoxyribonucleotides×100)/(Length of Alignment−Total Number of Gaps in Alignment)

Fragment: The term "fragment" means a polypeptide having one or more (several) amino acids deleted from the amino and/or carboxyl terminus of a mature polypeptide; wherein the fragment has endoglucanase activity.

Subsequence: The term "subsequence" means a polynucleotide having one or more (several) nucleotides deleted from the 5' and/or 3' end of a mature polypeptide coding sequence; wherein the subsequence encodes a fragment having endoglucanase activity.

Allelic variant: The term "allelic variant" means any of two or more alternative forms of a gene occupying the same chromosomal locus. Allelic variation arises naturally through mutation, and may result in polymorphism within populations. Gene mutations can be silent (no change in the encoded polypeptide) or may encode polypeptides having altered amino acid sequences. An allelic variant of a polypeptide is a polypeptide encoded by an allelic variant of a gene.

Coding sequence: The term "coding sequence" means a polynucleotide, which directly specifies the amino acid sequence of a polypeptide. The boundaries of the coding sequence are generally determined by an open reading frame, which usually begins with the ATG start codon or alternative start codons such as GTG and TTG and ends with a stop codon such as TAA, TAG, and TGA. The coding sequence may be a DNA, cDNA, synthetic, or recombinant polynucleotide.

cDNA: The term "cDNA" means a DNA molecule that can be prepared by reverse transcription from a mature, spliced, mRNA molecule obtained from a eukaryotic cell. cDNA lacks intron sequences that may be present in the corresponding genomic DNA. The initial, primary RNA transcript is a precursor to mRNA that is processed through a series of steps, including splicing, before appearing as mature spliced mRNA.

Nucleic acid construct: The term "nucleic acid construct" means a nucleic acid molecule, either single- or double-stranded, which is isolated from a naturally occurring gene or is modified to contain segments of nucleic acids in a manner that would not otherwise exist in nature or which is synthetic. The term nucleic acid construct is synonymous with the term "expression cassette" when the nucleic acid construct contains the control sequences required for expression of a coding sequence of the present invention.

Control sequences: The term "control sequences" means all components necessary for the expression of a polynucleotide encoding a polypeptide of the present invention. Each control sequence may be native or foreign to the polynucleotide encoding the polypeptide or native or foreign to each other. Such control sequences include, but are not limited to, a leader, polyadenylation sequence, propeptide sequence, promoter, signal peptide sequence, and transcription terminator. At a minimum, the control sequences include a promoter, and transcriptional and translational stop signals. The control sequences may be provided with linkers for the purpose of introducing specific restriction sites facilitating ligation of the control sequences with the coding region of the polynucleotide encoding a polypeptide.

Operably linked: The term "operably linked" means a configuration in which a control sequence is placed at an appropriate position relative to the coding sequence of a polynucleotide such that the control sequence directs the expression of the coding sequence.

Expression: The term "expression" includes any step involved in the production of the polypeptide including, but not limited to, transcription, post-transcriptional modification, translation, post-translational modification, and secretion.

Expression vector: The term "expression vector" means a linear or circular DNA molecule that comprises a polynucleotide encoding a polypeptide and is operably linked to additional nucleotides that provide for its expression.

Host cell: The term "host cell" means any cell type that is susceptible to transformation, transfection, transduction, and the like with a nucleic acid construct or expression vector comprising a polynucleotide of the present invention. The term "host cell" encompasses any progeny of a parent cell that is not identical to the parent cell due to mutations that occur during replication.

Variant: The term "variant" means a polypeptide having endoglucanse activity comprising an alteration, i.e., a substitution, insertion, and/or deletion of one or more (several) amino acid residues at one or more (several) positions. A substitution means a replacement of an amino acid occupying a position with a different amino acid; a deletion means removal of an amino acid occupying a position; and an insertion means adding 1-3 amino acids adjacent to an amino acid occupying a position.

Textile: The term "textiles" used herein is meant to include fibers, yarns, fabrics and garments.

Fabric can be constructed from fibers by weaving, knitting or non-woven operations. Weaving and knitting require yarn as the input whereas the non-woven fabric is the result of random bonding of fibers (paper can be thought of as non-woven). In the present context, the term "fabric" is also intended to include fibers and other types of processed fabrics.

According to the invention, the method of the invention may be applied to any textile known in the art (woven, knitted, or non-woven). In particular the process of the present invention may be applied to cellulose-containing or cellulosic textile, such as cotton, viscose, rayon, ramie, linen, lyocell (e.g., Tencel, produced by Courtaulds Fibers), or mixtures thereof, or mixtures of any of these fibers together with synthetic fibres (e.g., polyester, polyamid, nylon) or other natural fibers such as wool and silk, such as viscose/cotton blends, lyocell/cotton blends, viscose/wool blends, lyocell/wool blends, cotton/wool blends; flax (linen), ramie and other fabrics based on cellulose fibers, including all blends of cellulosic fibers with other fibers such as wool, polyamide, acrylic and polyester fibers, e.g., viscose/cotton/polyester blends, wool/cotton/polyester blends, flax/cotton blends etc.

DETAILED DESCRIPTION OF THE INVENTION

Polypeptides Having Endoglucanse Activity but without Functional CBM

The present invention relates to a method for treating textile, by treating textile with an isolated polypeptide which has endoglucanase activity but does not comprise a functional CBM, selected from the group consisting of:

(a) a polypeptide having at least 80% sequence identity to the mature polypeptide of SEQ ID NO: 2;

(b) a polypeptide encoded by a polynucleotide that hybridizes under medium stringency conditions, with (i) the mature polypeptide coding sequence of SEQ ID NO: 1, or (ii) the cDNA sequence contained in the mature polypeptide coding sequence of SEQ ID NO: 1, or (iii) the full-length complementary strand of (i) or (ii);

(c) a polypeptide encoded by a polynucleotide having at least 80% sequence identity to the mature polypeptide coding sequence of SEQ ID NO: 1; or (d) a polypeptide which can be obtained from SEQ ID NO: 2 by substitution, deletion, and/or insertion of one or more (or several) amino acids.

In the present invention, the isolated polypeptides having endoglucanase activity but without functional CBM have sequence identity to the mature polypeptide of SEQ ID NO: 2 of at least 80%, at least 85%, at least 90%, at least 95%, at least 96%, at least 97%, at least 98%, at least 99%, or 100%. In one aspect, the polypeptides differ by no more than ten amino acids, e.g., by ten amino acids, nine amino acids, eight amino acids, seven amino acids, six amino acids, five amino acids, four amino acids, three amino acids, two amino acids, or one amino acid from the mature polypeptide of SEQ ID NO: 2. Preferably, the polypeptide identified above has a histidine at the position corresponding to position 141 when aligned with SEQ ID NO: 2. More preferably, the isolated polypeptide is a catalytic module of endoglucanse. Even more preferably, the isolated polypeptide of the present invention is a mature polypeptide of SEQ ID NO: 2.

The present invention also relates to isolated polypeptides having endoglucanse activity that are encoded by polynucleotides that hybridize under very low stringency conditions, low stringency conditions, medium stringency conditions, medium-high stringency conditions, high stringency conditions, or very high stringency conditions with (i) the mature polypeptide coding sequence of SEQ ID NO: 1, (ii) the cDNA sequence contained in the mature polypeptide coding sequence of SEQ ID NO: 1, or (iii) the full-length complementary strand of (i) or (ii) (J. Sambrook, E. F. Fritsch, and T. Maniatis, 1989, *Molecular Cloning, A Laboratory Manual,* 2d edition, Cold Spring Harbor, N.Y.).

The polynucleotide of SEQ ID NO: 1 or a subsequence thereof, as well as the amino acid sequence of SEQ ID NO: 2 or a fragment thereof, may be used to design nucleic acid probes to identify and clone DNA encoding polypeptides having endoglucanase activity from strains of different genera or species according to methods well known in the art. In particular, such probes can be used for hybridization with the genomic or cDNA of the genus or species of interest, following standard Southern blotting procedures, in order to identify and isolate the corresponding gene therein. Such probes can be considerably shorter than the entire sequence, but should be at least 14, e.g., at least 25, at least 35, or at least 70 nucleotides in length. Preferably, the nucleic acid probe is at least 100 nucleotides in length, e.g., at least 200 nucleotides, at least 300 nucleotides, at least 400 nucleotides, at least 500 nucleotides, at least 600 nucleotides, at least 700 nucleotides, at least 800 nucleotides, or at least 900 nucleotides in length. Both DNA and RNA probes can be used. The probes are typically labeled for detecting the corresponding gene (for example, with $^{32}P$, $^{3}H$, $^{35}S$, biotin, or avidin). Such probes are encompassed by the present invention.

A genomic DNA or cDNA library prepared from such other strains may be screened for DNA that hybridizes with the probes described above and encodes a polypeptide having endoglucanse activity. Genomic or other DNA from such other strains may be separated by agarose or polyacrylamide gel electrophoresis, or other separation techniques. DNA from the libraries or the separated DNA may be transferred to and immobilized on nitrocellulose or other suitable carrier material. In order to identify a clone or DNA that is homologous with SEQ ID NO: 1 or a subsequence thereof, the carrier material is preferably used in a Southern blot.

For purposes of the present invention, hybridization indicates that the polynucleotide hybridizes to a labeled nucleic acid probe corresponding to the mature polypeptide coding sequence of SEQ ID NO: 1; the cDNA sequence contained in the mature polypeptide coding sequence of SEQ ID NO: 1, or the mature polypeptide coding sequence of SEQ ID NO: 1; its full-length complementary strand; or a subsequence thereof; under very low to very high stringency conditions. Molecules to which the nucleic acid probe hybridizes under these conditions can be detected using, for example, X-ray film.

In one aspect, the nucleic acid probe is the mature polypeptide coding sequence of SEQ ID NO: 1. In another aspect, the nucleic acid probe is a polynucleotide that encodes the polypeptide of SEQ ID NO: 2 or a fragment thereof. In another preferred aspect, the nucleic acid probe is SEQ ID NO: 1.

For long probes of at least 100 nucleotides in length, very low to very high stringency conditions are defined as prehybridization and hybridization at 42° C. in 5×SSPE, 0.3% SDS, 200 micrograms/ml sheared and denatured salmon sperm DNA, and either 25% formamide for very low and low stringencies, 35% formamide for medium and medium-high stringencies, or 50% formamide for high and very high stringencies, following standard Southern blotting procedures for 12 to 24 hours optimally. The carrier material is finally washed three times each for 15 minutes using 2×SSC, 0.2% SDS at 45° C. (very low stringency), at 50° C. (low stringency), at 55° C. (medium stringency), at 60° C. (medium-high stringency), at 65° C. (high stringency), and at 70° C. (very high stringency).

For short probes of about 15 nucleotides to about 70 nucleotides in length, stringency conditions are defined as prehybridization and hybridization at about 5° C. to about 10° C.

below the calculated $T_m$ using the calculation according to Bolton and McCarthy (1962, *Proc. Natl. Acad. Sci. USA* 48:1390) in 0.9 M NaCl, 0.09 M Tris-HCl pH 7.6, 6 mM EDTA, 0.5% NP-40, 1×Denhardt's solution, 1 mM sodium pyrophosphate, 1 mM sodium monobasic phosphate, 0.1 mM ATP, and 0.2 mg of yeast RNA per ml following standard Southern blotting procedures for 12 to 24 hours optimally. The carrier material is finally washed once in 6×SCC plus 0.1% SDS for 15 minutes and twice each for 15 minutes using 6×SSC at 5° C. to 10° C. below the calculated $T_m$.

The present invention also relates to isolated polypeptides having endoglucanse activity encoded by polynucleotides having a sequence identity to the mature polypeptide coding sequence of SEQ ID NO: 1 of at least 80%, at least 85%, at least 90%, at least 95%, at least 96%, at least 97%, at least 98%, at least 99%, or 100%.

In the present invention, the polypeptide can be variants comprising a substitution, deletion, and/or insertion of one or more (or several) amino acids of the mature polypeptide of SEQ ID NO: 2, or a homologous sequence thereof. Preferably, amino acid changes are of a minor nature, that is conservative amino acid substitutions or insertions that do not significantly affect the folding and/or activity of the protein; small deletions, typically of one to about 30 amino acids; small amino- or carboxyl-terminal extensions, such as an amino-terminal methionine residue; a small linker peptide of up to about 20-25 residues; or a small extension that facilitates purification by changing net charge or another function, such as a poly-histidine tract, an antigenic epitope or a binding domain. Preferably, the amino acid residue corresponding to position 141 of SEQ ID NO: 2 is histidine. SEQ ID NO: 2 can be obtained by substituting the glutamine residue (Q) with histidine (H) in the catalytic module of wild-type *Thielavia terrestris* endoglucanse in position corresponding to position 141 of SEQ ID NO: 2.

Examples of conservative substitutions are within the group of basic amino acids (arginine, lysine and histidine), acidic amino acids (glutamic acid and aspartic acid), polar amino acids (glutamine and asparagine), hydrophobic amino acids (leucine, isoleucine and valine), aromatic amino acids (phenylalanine, tryptophan and tyrosine), and small amino acids (glycine, alanine, serine, threonine and methionine). Amino acid substitutions that do not generally alter specific activity are known in the art and are described, for example, by H. Neurath and R. L. Hill, 1979, *In, The Proteins*, Academic Press, New York. The most commonly occurring exchanges are Ala/Ser, Val/Ile, Asp/Glu, Thr/Ser, Ala/Gly, Ala/Thr, Ser/Asn, Ala/Val, Ser/Gly, Tyr/Phe, Ala/Pro, Lys/Arg, Asp/Asn, Leu/Ile, Leu/Val, Ala/Glu, and Asp/Gly.

Alternatively, the amino acid changes are of such a nature that the physico-chemical properties of the polypeptides are altered. For example, amino acid changes may improve the thermal stability of the polypeptide, alter the substrate specificity, change the pH optimum, and the like.

One or more of the mutations like G43K, N71E and Q168R could be introduced into SEQ ID NO: 2 of the present invention. For an amino acid substitution, the following nomenclature is used: Original amino acid, position, substituted amino acid. Accordingly, the substitution of Glycine with Lysine at position 43 is designated as "Gly43Lys" or "G43K".

Essential amino acids in a parent polypeptide can be identified according to procedures known in the art, such as site-directed mutagenesis or alanine-scanning mutagenesis (Cunningham and Wells, 1989, *Science* 244: 1081-1085). In the latter technique, single alanine mutations are introduced at every residue in the molecule, and the resultant mutant molecules are tested for endoglucanse activity to identify amino acid residues that are critical to the activity of the molecule. See also, Hilton et al., 1996, *J. Biol. Chem.* 271: 4699-4708. The active site of the enzyme or other biological interaction can also be determined by physical analysis of structure, as determined by such techniques as nuclear magnetic resonance, crystallography, electron diffraction, or photoaffinity labeling, in conjunction with mutation of putative contact site amino acids. See, for example, de Vos et al., 1992, *Science* 255: 306-312; Smith et al., 1992, *J. Mol. Biol.* 224: 899-904; Wlodaver et al., 1992, *FEBS Lett.* 309: 59-64. The identities of essential amino acids can also be inferred from analysis of identities with polypeptides that are related to the parent polypeptide.

In the present invention, D33 and D143 in SEQ ID NO: 2 are essential amino acid, which is unchangeable in order to maintain its endoglucanse activity.

Single or multiple amino acid substitutions, deletions, and/or insertions can be made and tested using known methods of mutagenesis, recombination, and/or shuffling, followed by a relevant screening procedure, such as those disclosed by Reidhaar-Olson and Sauer, 1988, *Science* 241: 53-57; Bowie and Sauer, 1989, *Proc. Natl. Acad. Sci. USA* 86: 2152-2156; WO 95/17413; or WO 95/22625. Other methods that can be used include error-prone PCR, phage display (e.g., Lowman et al., 1991, *Biochemistry* 30: 10832-10837; U.S. Pat. No. 5,223,409; WO 92/06204), and region-directed mutagenesis (Derbyshire et al., 1986, *Gene* 46: 145; Ner et al., 1988, *DNA* 7: 127).

Mutagenesis/shuffling methods can be combined with high-throughput, automated screening methods to detect activity of cloned, mutagenized polypeptides expressed by host cells (Ness et al., 1999, *Nature Biotechnology* 17: 893-896). Mutagenized DNA molecules that encode active polypeptides can be recovered from the host cells and rapidly sequenced using standard methods in the art. These methods allow the rapid determination of the importance of individual amino acid residues in a polypeptide.

Preferably, the total number of amino acid substitutions, deletions and/or insertions of the mature polypeptide of SEQ ID NO: 2 is not more than 10, e.g., 1, 2, 3, 4, 5, 6, 7, 8 or 9.

The polypeptide may be hybrid polypeptide in which a portion of one polypeptide is fused at the N-terminus or the C-terminus of a portion of another polypeptide.

The polypeptide may be a fused polypeptide or cleavable fusion polypeptide in which another polypeptide is fused at the N-terminus or the C-terminus of the polypeptide of the present invention. A fused polypeptide is produced by fusing a polynucleotide encoding another polypeptide to a polynucleotide of the present invention. Techniques for producing fusion polypeptides are known in the art, and include ligating the coding sequences encoding the polypeptides so that they are in frame and that expression of the fused polypeptide is under control of the same promoter(s) and terminator. Fusion proteins may also be constructed using intein technology in which fusions are created post-translationally (Cooper et al., 1993, *EMBO J.* 12: 2575-2583; Dawson et al., 1994, *Science* 266: 776-779).

A fusion polypeptide can further comprise a cleavage site between the two polypeptides. Upon secretion of the fusion protein, the site is cleaved releasing the two polypeptides. Examples of cleavage sites include, but are not limited to, the sites disclosed in Martin et al., 2003, *J. Ind. Microbiol. Biotechnol.* 3: 568-576; Svetina et al., 2000, *J. Biotechnol.* 76: 245-251; Rasmussen-Wilson et al., 1997, *Appl. Environ. Microbiol.* 63: 3488-3493; Ward et al., 1995, *Biotechnology* 13: 498-503; and Contreras et al., 1991, *Biotechnology* 9: 378-381; Eaton et al., 1986, *Biochemistry* 25: 505-512; Collins-Racie et al., 1995, *Biotechnology* 13: 982-987; Carter et al., 1989, *Proteins: Structure, Function, and Genetics* 6: 240-248; and Stevens, 2003, Drug Discovery World 4: 35-48.

Source of the Polypeptides of the Present Invention

A polypeptide having endoglucanse activity but without a functional CBM, of the present invention may be obtained from microorganisms of any genus. For purposes of the present invention, the term "obtained from" as used herein in connection with a given source shall mean that the polypeptide encoded by a polynucleotide is produced by the source or by a strain in which the polynucleotide from the source has been inserted. In one aspect, the polypeptide obtained from a given source is secreted extracellularly.

The polypeptide may be a bacterial polypeptide. For example, the polypeptide may be a Gram-positive bacterial polypeptide such as a *Bacillus, Clostridium, Enterococcus, Geobacillus, Lactobacillus, Lactococcus, Oceanobacillus, Staphylococcus, Streptococcus*, or *Streptomyces* polypeptide having endoglucanase activity, or a Gram-negative bacterial polypeptide such as a *Campylobacter, E. coli, Flavobacterium, Fusobacterium, Helicobacter, Ilyobacter, Neisseria, Pseudomonas, Salmonella, Dictyoglomus* or *Ureaplasma* polypeptide.

In one aspect, the polypeptide is a *Dictyoglomus thermophilum*, or *Dictyoglomus turgidum* polypeptide.

The polypeptide may be an *Archaea* peptide. For example, the polypeptide may be a *Pyrococcus* polypeptide. In one aspect, the polypeptide is *Pyrococcus furiosus, Pyrococcus abyssi, Pyrococcus endeavori, Pyrococcus glycovorans, Pyrococcus horikoshii, Pyrococcus woesei* polypeptide. The polypeptide may be a fungal polypeptide. For example, the polypeptide may be a yeast polypeptide such as a *Candida, Kluyveromyces, Pichia, Saccharomyces, Schizosaccharomyces*, or *Yarrowia* polypeptide; or a filamentous fungal polypeptide such as an *Acremonium, Agaricus, Alternaria, Aspergillus, Aureobasidium, Botryospaeria, Ceriporiopsis, Chaetomidium, Chrysosporium, Claviceps, Cochliobolus, Coprinopsis, Coptotermes, Corynascus, Cryphonectria, Cryptococcus, Diplodia, Exidia, Filibasidium, Fusarium, Gibberella, Holomastigotoides, Humicola, Irpex, Lentinula, Leptospaeria, Magnaporthe, Melanocarpus, Meripilus, Mucor, Myceliophthora, Neocallimastix, Neurospora, Paecilomyces, Penicillium, Phanerochaete, Piromyces, Poitrasia, Pseudoplectania, Pseudotrichonympha, Rhizomucor, Schizophyllum, Scytalidium, Talaromyces, Thermoascus, Thielavia, Tolypocladium, Trichoderma, Trichophaea, Verticillium, Volvariella*, or *Xylaria* polypeptide.

In another aspect, the polypeptide is an *Acremonium cellulolyticus, Aspergillus aculeatus, Aspergillus awamori, Aspergillus foetidus, Aspergillus fumigatus, Aspergillus japonicus, Aspergillus nidulans, Aspergillus niger, Aspergillus oryzae, Chrysosporium inops, Chrysosporium keratinophilum, Chrysosporium lucknowense, Chrysosporium merdarium, Chrysosporium pannicola, Chrysosporium queenslandicum, Chrysosporium tropicum, Chrysosporium zonatum, Fusarium bactridioides, Fusarium cerealis, Fusarium crookwellense, Fusarium culmorum, Fusarium graminearum, Fusarium graminum, Fusarium heterosporum, Fusarium negundi, Fusarium oxysporum, Fusarium reticulatum, Fusarium roseum, Fusarium sambucinum, Fusarium sarcochroum, Fusarium sporotrichioides, Fusarium sulphureum, Fusarium torulosum, Fusarium trichothecioides, Fusarium venenatum, Humicola grisea, Humicola insolens, Humicola lanuginosa, Irpex lacteus, Mucor miehei, Myceliophthora thermophila, Neurospora crassa, Penicillium funiculosum, Penicillium purpurogenum, Phanerochaete chrysosporium, Thielavia achromatica, Thielavia albomyces, Thielavia albopilosa, Thielavia australeinsis, Thielavia fimeti, Thielavia microspora, Thielavia ovispora, Thielavia peruviana, Thielavia setosa, Thielavia spededonium, Thielavia subthermophila, Thielavia terrestris, Trichoderma harzianum, Trichoderma koningii, Trichoderma longibrachiatum, Trichoderma reesei*, or *Trichoderma viride* polypeptide.

It will be understood that for the aforementioned species, the invention encompasses both the perfect and imperfect states, and other taxonomic equivalents, e.g., anamorphs, regardless of the species name by which they are known. Those skilled in the art will readily recognize the identity of appropriate equivalents.

Strains of these species are readily accessible to the public in a number of culture collections, such as the American Type Culture Collection (ATCC), Deutsche Sammlung von Mikroorganismen und Zellkulturen GmbH (DSMZ), Centraalbureau Voor Schimmelcultures (CBS), and Agricultural Research Service Patent Culture Collection, Northern Regional Research Center (NRRL).

The polypeptide may be identified and obtained from other sources including microorganisms isolated from nature (e.g., soil, composts, water, etc.) or DNA samples obtained directly from natural materials (e.g., soil, composts, water, etc.) using the above-mentioned probes. Techniques for isolating microorganisms and DNA directly from natural habitats are well known in the art. A polynucleotide encoding the polypeptide may then be obtained by similarly screening a genomic DNA or cDNA library of another microorganism or mixed DNA sample. Once a polynucleotide encoding a polypeptide has been detected with the probe(s), the polynucleotide can be isolated or cloned by utilizing techniques that are known to those of ordinary skill in the art (see, e.g., Sambrook et al., 1989, supra).

Other Components

In some embodiments of the invention, the bulk solution containing the polypeptide having endoglucanase activity further comprises other components, including without limitation other enzymes, as well as one or more of surfactants, bleaching agents, antifoaming agents, builder systems, and the like, that enhance the biopolishing and/or biostoning process and/or provide superior effects related to, e.g., dyeability and/or wettability. The aqueous solution may also contain dyeing agents.

Enzymes suitable for use in the present invention include without limitation proteases, lipases, cutinases, amylases, hemicellulases, pectinases, and cellulases.

Proteases

In a preferred embodiment, proteases are used in the present invention. Suitable proteases include those of animal, vegetable or microbial origin. Microbial origin is preferred. Chemically modified or protein engineered mutants are included. The protease may for example be a metalloprotease (EC 3.4.17 or EC 3.4.24) or a serine protease (EC 3.4.21), preferably an alkaline microbial protease or a trypsin-like protease. Examples of proteases are subtilisins (EC 3.4.21.62), especially those derived from *Bacillus*, e.g., subtilisin Novo, subtilisin Carlsberg, subtilisin 309, subtilisin 147 and subtilisin 168 (described in WO 89/06279). Examples of trypsin-like proteases are trypsin (e.g., of porcine or bovine origin) and the *Fusarium* protease described in WO 89/06270 and WO 94/25583.

Preferred commercially available protease enzymes include Alcalase®, Savinase®, Primase®, Duralase®, Esperase®, and Kannase® (Novozymes A/S), Maxatase®, Maxacal®, Maxapem®, Properase®, Purafect®, Purafect OxP®, FN2™, and FN3™ (Genencor International Inc.).

Lipases

In other embodiments of the present invention, lipases are used in the present invention. Suitable lipases include those of bacterial or fungal origin. Chemically or genetically modified mutants of such lipases are included in this connection. The lipase may for example be triacylglycerol lipase (EC3.1.1.3), phospholipase A2 (EC 3.1.1.4), Lysophospholipase (EC 3.1.1.5), Monoglyceride lipase (EC 3.1.1.23), galactolipase (EC 3.1.1.26), phospholipase A1 (EC 3.1.1.32), Lipoprotein lipase (EC 3.1.1.34). Examples of useful lipases include a *Humicola lanuginosa* lipase, e.g., as described in EP 258 068 and EP 305 216; a *Rhizomucor miehei* lipase, e.g., as described in EP 238 023 or from *H. insolens* as described in WO 96/13580; a *Candida* lipase, such as a *C. antarctica* lipase, e.g., the *C. antarctica* lipase A or B described in EP 214 761; a *Pseudomonas lipase*, such as one of those described in EP 721 981 (e.g., a lipase obtainable from a *Pseudomonas* sp. SD705 strain having deposit accession number FERM BP-4772), in PCT/JP96/00426, in PCT/JP96/00454 (e.g., a *P. solanacearum* lipase), in EP 571 982 or in WO 95/14783 (e.g., a *P. mendocina* lipase), a *P. alcaligenes* or *P. pseudoalcaligenes* lipase, e.g., as described in EP 218 272, a *P. cepacia* lipase, e.g., as described in EP 331 376, a *P. stutzeri* lipase, e.g., as disclosed in GB 1,372,034, or a *P. fluorescens* lipase; a *Bacillus lipase*, e.g., a *B. subtilis* lipase (Dartois et al. (1993) Biochemica et Biophysica Acta 1131: 253-260), a *B. stearothermophilus* lipase (JP 64/744992) and a *B. pumilus* lipase (WO 91/16422).

Suitable commercially available lipases include Lipex®, Lipolase® and Lipolase Ultra®, Lipolex®, Lipoclean® (available from Novozymes A/S), M1 Lipase™ and Lipomax™ (available from Genencor Inc.) and Lipase P "Amano" (available from Amano Pharmaceutical Co. Ltd.). Commercially available cutinases include Lumafast™ from Genencor Inc.

Cutinases

In other embodiments, cutinases are used in the present invention. Potentially useful types of lipolytic enzymes include cutinases (EC 3.1.1.74), e.g., a cutinase derived from Pseudomonas mendocina as described in WO 88/09367, or a cutinase derived from *Fusarium solani pisi* (described, e.g., in WO 90/09446). Due to the lipolytic activity of cutinases they may be effective against the same stains as lipases. Commercially available cutinases include Lumafast™ from Genencor Inc.

Amylases

In other embodiments, amylases are used in the present invention. Amylases comprise e.g., alpha-amylases (EC 3.2.1.1), beta-amylases (EC 3.2.1.2) and/or glucoamylases (EC 3.2.1.3) of bacterial or fungal origin. Chemically or genetically modified mutants of such amylases are included in this connection. Alpha-amylases are preferred in relation to the present invention. Relevant alpha-amylases include, for example, α-amylases obtainable from *Bacillus* species, in particular a special strain of *B. licheniformis*, described in more detail in GB 1296839.

Further examples of useful amylases are the alpha-amylases derived from *Bacillus* sp. he AA560 alpha-amylase derived from *Bacillus* sp. DSM 12649 disclosed as SEQ ID NO: 2 in WO 00/60060 (hereby incorporated by reference) and the variants of the AA560 alpha-amylase, including the AA560 variant disclosed in Example 7 and 8 (hereby incorporated by reference).

Relevant commercially available amylases include Natalase®, Stainzyme®, Duramyl®, Termamyl®, Termamyl™ Ultra, Fungamyl® and BAN® (all available from Novozymes A/S, Bagsvaerd, Denmark), and Rapidase® and Maxamyl® P (available from DSM, Holland) and Purastar®, Purastar OxAm and Powerase™ (available from Danisco A/S).

Other useful amylases are CGTases (cyclodextrin glucanotransferases, EC 2.4.1.19), e.g., those obtainable from species of *Bacillus, Thermoanaerobactor* or *Thermoanaerobacterium.*

Hemicellulases

In other embodiments, hemicellulases are used in the present invention. Hemicelluloses are the most complex group of non-starch polysaccharides in the plant cell wall. They consist of polymers of xylose, arabinose, galactose, mannose and/or glucose which are often highly branched and connected to other cell wall structures. Hemicellulases of the present invention therefore include enzymes with xylanolytiactivity, arabinolytic activity, galactolytic activity and/or mannolytic activity. The hemi-cellulases of the present invention may for example be selected from xylanases (EC 3.2.1.8, EC 3.2.1.32, and EC 3.2.1.136), xyloglucanases (EC 3.2.1.4 and EC 3.2.1.151), arabinofuranosidases (EC 3.2.1.55), acetylxylan esterases (EC EC 3.1.1.72), glucuronidases (EC 3.2.1.31, EC 3.2.1.56, 3.2.1.128 and 3.2.1.139), glucanohydrolase (EC 3.2.1.11, EC 3.2.1.83 and EC 3.2.1.73), ferulic acid esterases (EC 3.1.1.73), coumaric acid esterases (EC 3.1.1.73), mannanases (EC 3.2.1.25; EC 3.2.1.78 and EC 3.2.1.101), arabinosidase (EC 3.2.1.88), arabinanases (EC 3.2.1.99), galactanases (EC 3.2.1.89, EC 3.2.1.23 and 3.2.1.164) and lichenases (EC 3.2.1.73). This is, however, not to be considered as an exhausting list.

Mannananase is a preferred hemicellulase in relation to the present invention. Mannanases hydrolyse the biopolymers made up of galactomannans. Mannan containing stains often comprise guar gum and locust bean gum, which are widely used as stabilizers in food and cosmetic products. Suitable mannanases include those of bacterial or fungal origin. Chemically or genetically modified mutants are included. In a preferred embodiment the mannanase is derived from a strain of the genus *Bacillus*, especially *Bacillus* sp. 1633 disclosed in positions 31-330 of SEQ ID NO:2 or in SEQ ID NO: 5 of WO 99/64619 (hereby incorporated by reference) or *Bacillus agaradhaerens*, for example from the type strain DSM 8721. A suitable commercially available mannanase is Mannaway® produced by Novozymes A/S or Purabrite™ produced by Genencor a Danisco division.

Xylanase is a preferred hemicellulase in relation to the present invention. A suitable commercially available xylanase is Pulpzyme® HC (available from Novozymes A/S).

Pectinases

In other embodiments, pectinases are used in the present invention. The term pectinase or pectolytic enzyme is intended to include any pectinase enzyme defined according to the art where pectinases are a group of enzymes that catalyze the cleavage of glycosidic linkages. Basically three types of pectolytic enzymes exist: pectinesterase, which only removes methoxyl residues from pectin, a range of depolymerizing enzymes, and protopectinase, which solubilizes protopectin to form pectin (Sakai et al., (1993) Advances in Applied Microbiology vol 39 pp 213-294). Example of a pectinases or pectolytic enzyme useful in the invention is pectate lyase (EC 4.2.2.2 and EC 4.2.2.9), polygalacturonase (EC 3.2.1.15 and EC 3.2.1.67), polymethyl galacturonase, pectin lyase (EC 4.2.2.10), galactanases (EC 3.2.1.89), arabinanases (EC 3.2.1.99) and/or pectin esterases (EC 3.1.1.11).

Suitable pectinolytic enzymes include those described in WO 99/27083, WO 99/27084, WO 00/55309 and WO 02/092741.

Suitable pectate lyases include those of bacterial or fungal origin. Chemically or genetically modified mutants are included. In a preferred embodiment the pectate lyase is derived from a strain of the genus *Bacillus*, especially a strain of *Bacillus substilis*, especially *Bacillus subtilis* DSM14218 disclosed in SEQ ID NO:2 or a variant thereof disclosed in Example 6 of WO 02/092741 (hereby incorporated by reference) or a variant disclosed in WO 03/095638 (hereby incorporated by reference). Alternatively the pectate lyase is derived from a strain of *Bacillus licheniformis*, especially the pectate lyases disclosed as SEQ ID NO: 8 in WO 99/27083 (hereby incorporated by reference) or variants thereof as described in WO 02/06442.

Suitable commercially available pectate lyases are Pectaway® or X Pect® produced by Novozymes A/S.

Cellulases

The method of the present invention may further include other cellulase different from the polypeptide with endoglucanse activity defined in the present invention. In the present context, the term "cellulase" or "cellulolytic enzyme" refers to an enzyme which catalyzes the degradation of cellulose to glucose, cellobiose, triose and other cello-oligosaccharides which enzyme is understood to include a mature protein or a precursor form thereof or a functional fragment thereof, e.g., a catalytic active module, which essentially has the activity of the full-length enzyme. Furthermore, the term "cellulolytic" enzyme is intended to include homologues or analogues of said enzyme. Suitable cellulases include those of animal, vegetable or microbial origin. Microbial origin is preferred. The cellulolytic enzyme may be a component occurring in a cellulase system produced by a given microorganism, such a cellulase system mostly comprising several different cellulase enzyme components including those usually identified as, e.g., cellobiohydrolases, endoglucanases, and beta-glucosidases. In a preferred embodiment the cellulase is an endoglucanase.

Examples of commercially available cellulase enzyme products useful in the method of the present invention are: Cellusoft CR®, Cellusoft L®, Novoprime A 378® all available from Novo Nordisk A/S, DK-2880 Bagsvaerd, Denmark); Indiage™, Primafast™ (both from Genencor International Inc., U.S.A.); Powerstone™ (from Iogen, Canada); Ecostone™ (from Alko, Finland); Rocksoft™ (from CPN, U.S.A.), and Sanko Bio™ (from Meiji/Rakuto Kasei Ltd., Japan).

Textile Manufacturing Process

The processing of a fabric, such as of a cellulosic material, into material ready for garment manufacturing involves several steps: spinning of the fiber into a yarn; construction of woven or knit fabric from the yarn; and subsequent preparation processes, dyeing/printing and finishing operations. Preparation processes are necessary for removing natural and man-induced impurities from fibers and for improving their aesthetic appearance and processability prior to for instance dyeing/printing and finishing. Common preparation processes comprise desizing (for woven goods), scouring, and bleaching, which produce a fabric suitable for dyeing or finishing.

Woven fabric is constructed by weaving "filling" or "weft" yarns between warp yarns stretched in the longitudinal direction on the loom. The warp yarns must be sized before weaving in order to lubricate and protect them from abrasion at the high speed insertion of the filling yarns during weaving. Common size agents are starches (or starch derivatives and modified starches), polyvinyl alcohol), carboxylmethyl cellulose (i.e. CMC) where starches are dominant. Paraffin, acrylic binders and variety of lubricants are often included in the size mix. The filling yarn can be woven through the warp yarns in a "over one-under the next" fashion (plain weave) or by "over one-under two" (twill) or any other myriad of permutations. Generally, dresses, shirts, pants, sheeting's, towels, draperies, etc. are produced from woven fabric. After the fabric is made, size on the fabric must be removed again (i.e. desizing).

Knitting is forming a fabric by joining together interlocking loops of yarn. As opposed to weaving, which is constructed from two types of yarn and has many "ends", knitted fabric is produced from a single continuous strand of yarn. As with weaving, there are many different ways to loop yarn together and the final fabric properties are dependent both upon the yarn and the type of knit. Underwear, sweaters, socks, sport shirts, sweat shirts, etc. are derived from knit fabrics.

Desizing

Desizing is the degradation and/or removal of sizing compounds from warp yarns in a woven fabric. Starch is usually removed by an enzymatic desizing procedure. In addition, oxidative desizing and chemical desizing with acids or bases are sometimes used.

In some embodiments, the desizing enzyme is an amylolytic enzyme, such as an alpha-amylase, a beta-amylase, a mannanases, a glucoamylases, or a combination thereof.

Suitable alpha and beta-amylases include those of bacterial or fungal origin, as well as chemically or genetically modified mutants and variants of such amylases. Suitable alpha-amylases include alpha-amylases obtainable from *Bacillus* species. Suitable commercial amylases include but are not limited to OPTISIZE® NEXT, OPTISIZE® FLEX and OPTISIZE® COOL (all from Genencor International Inc.), and DURAMYL™, ERMAMYL™, FUNGAMYL™ TERMAMYL™, AUQAZYME™ and BAN™ (all available from Novozymes A/S, Bagsvaerd, Denmark).

Other suitable amylolytic enzymes include the CGTases (cyclodextrin glucanotransferases, EC 2.4.1.19), e.g., those obtained from species of Bacillus, Thermoanaerobactor or Thermoanaero-bacterium.

Scouring

Scouring is used to remove impurities from the fibers, to swell the fibers and to remove seed coat. It is one of the most critical steps. The main purposes of scouring is to a) uniformly clean the fabric, b) soften the motes and other trashes, c) improve fabric absorbency, d) saponify and solubilize fats, oils, and waxes, and e) minimize immature cotton. Sodium hydroxide scouring at about boiling temperature is the accepted treatment for 100% cotton, while calcium hydroxide and sodium carbonate are less frequently used. Synthetic fibers are scoured at much milder conditions. Surfactant and chelating agents are essential for alkaline scouring. Enzymatic scouring has been introduced, wherein cellulase, hemicellulase, pectinase, lipase, and protease are all reported to have scouring effects.

Bleaching

Bleaching is the destruction of pigmented color and/or colored impurities as well as seed coat fragment removal. It is the most critical chemical treatment since a balance between the degrees of whiteness with fiber damage must be maintained. Bleaching is performed by the use of oxidizing or reducing chemistry. Oxidizing agents can be further subdivided into those that employ or generate: a) hypochlorite ($OCl^-$), b) chloride dioxide ($ClO_2$), and hydroperoxide species ($OOH^-$ and/or OOH). Reducing agents are typical sulfur dioxide, hydrosulfite salts, etc. Enzymatic bleaching using glucose oxidase has been reported. Traditionally, hydrogen peroxide is used in this process.

Printing and Dyeing

Printing or dyeing of textiles is carried out by applying dyes to the textile by any appropriate method for binding the dyestuff to the fibres in the textiles. The dyeing of textiles is for example carried out by passing the fabric through a concentrated solution of dye, followed by storage of the wet fabric in a vapour tight enclosure to permit time for diffusion and reaction of the dye with the fabric substrate prior to rinsing off un-reacted dye. Alternatively, the dye may be fixed by subsequent steaming of the textile prior to rinsing. The dyes include synthetic and natural dyes. Typical dyes are those with anionic functional groups (e.g. acid dyes, direct dyes, Mordant dyes and reactive dyes), those with cationic groups (e.g. basic dyes), those requiring chemical reaction before application (e.g. vat dyes, sulphur dyes and azoic dyes), disperse dyes and solvent dyes.

Excess soluble dyestuff not bound to the fibres must be removed after dyeing to ensure fastness of the dyed textiles and to prevent unwanted dye transfer during laundering of the textiles by the consumer. Generally, a large amount of water is required for complete removal of excess dye. In a conventional process, the printed or dyed textile is first rinsed with cold water, then washed at high temperature with the addition of a suitable additive to decrease backstaining, like poly(vinylpyrrolidone) (PVP).

An enzymatic process for removal of excess dye from dyed fabric with a rinse liquor comprising at least one peroxidise, an oxidase agent and at least one mediator, such as liquor comprising a peroxidase, hydrogen peroxidise and a mediator like 1-hydroxy-benzotriazole is disclosed in WO99/34054.

Biopolishing

As used herein, the term "biopolishing", "depilling" and "anti-pilling" are interchangeable.

Most cotton fabrics and cotton blend fabrics have a handle appearance that is rather hard and stiff without the application of finishing components. The fabric surface also is not smooth because small fuzzy microfibrils protrude from it. In addition, after a relatively short period of wear, pilling appears on the fabric surface thereby giving it an unappealing, worn look.

Biopolishing is a method to treat cellulosic fabrics during their manufacturing by enzymes such as cellulases, which improves fabric quality with respect to "reduced pilling formation". The most important effects of biopolishing can be characterised by less fuzz and pilling, increased gloss/luster, improved fabric handle, increased durable softness and/or improved water absorbency. Biopolishing usually takes place in the wet processing of the manufacture of knitted and woven fabrics or garments. Wet processing comprises such steps as e.g., desizing, scouring, bleaching, washing, dying/printing and finishing. Biopolishing could be performed as a separate step after any of the wetting steps or in combination with any of those wetting steps.

The method for manufacturing textile of the present invention, by treating textile with an isolated polypeptide having endoglucanase activity but without functional CBM as defined in the present invention can be applied to a biopolishing process.

In one embodiment, the invention provides a method for obtaining a cellulosic or cellulose-containing textile having a reduced pilling formation, the method comprising treating textile with a polypeptide having endoglucanase activity in an aqueous solution. In this embodiment, the method of biopolishing can be applied to yarn, fabric or garment.

In the present context, the term "reduced pilling formation" is intended to mean a resistance to formation of pills on the surface of the treated (biopolished) fabric surface according to the method of the present invention, in comparison with fabric without enzymatic treatment. For the purpose of the present invention, the pilling formation may be tested according the description of "pilling notes test" in the material and method section. The results of the test is expressed in terms of "pilling notes" which is a rating on a scale from pilling note 1 (heavy pill formation) to pilling note 5 (no pill formation), allowing 1/4 pilling notes.

Since the enzymes of the present invention catalyze hydrolysis of the cellulosic fibre surface, the enzymatic action will eventually result in a weight loss of fibre or fabric. In a preferred embodiment, even though the biopolishing is carried out in such a way so as to obtain a controlled, partial hydrolysis of the fibre surface, a proper polishing effect without excessive loss of fabric strength has hitherto been obtained.

For the purpose of the present invention, the biopolishing effect is measured under condition as specified in Example 5, by treatment of polypeptide of the present invention in Launder-O-Meter (LOM) at 55° C., pH 6.5 for 1 hour, with enzyme dosage of 0.63 mg/g fabric and LAS concentration of 0.5 g/L. In a preferred embodiment of the present invention, the polypeptide of the present invention shows pilling note of at least 3, preferably at least 3.2, more preferably at least 3.4, more preferably at least 3.6, more preferably at least 3.7, more preferably at least 3.8, more preferably at least 3.9, most preferably at least 4, while preferably at the same time shows weight loss of less than 10%, preferably less than 8%, more preferably less than 7%, more preferably less than 6%, more preferably less than 5%, more preferably less than 4%, more preferably less than 3.8%, more preferably less than 3.6%, more preferably less than 3.5%, more preferably less than 3.4%, more preferably less than 3.3%, more preferably less than 3.2%, more preferably less than 3.1%, most preferably less than 3%.

It is to be understood that the method of the invention can be carried out in any conventional wet textile processing step, preferably after the desizing or bleaching of the textile fabric, either simultaneously with a conventional process or as an additional process step. The method will typically be accomplished in high-speed circular systems such as jet-overflow dyeing machines, high-speed winches and jiggers. An example of a useful High-speed system is the "Aero 1000" manufactured by Biancalani, Italy. The method of the present invention can be carried out in a batch, continuous or semi-continuous apparatus, such as a J-Box, on a PadRoll or in a Pad-Bath.

Manufacturing of Denim Fabric

Some dyed fabric such as denim fabric, requires that the yarns are dyed before weaving. For denim fabric, the warp yarns are dyed for example with indigo, and sized before weaving. Preferably the dyeing of the denim yarn is a ring-dyeing. A preferred embodiment of the invention is ring-dyeing of the yarn with a vat dye such as indigo, or an indigo-related dye such as thioindigo, or a sulfur dye, or a direct dye, or a reactive dye, or a naphthol. The yarn may also be dyed with more than one dye, e.g., first with a sulphur dye and then with a vat dye, or vice versa.

Preferably, the yarns undergo scouring and/or bleaching before they are dyed, in order to achieve higher quality of denim fabric. In general, after woven into dyed fabric, such as denim, the dyed fabric or garment proceeds to a desizing stage, preferably followed by a biostoning step and/or a color modification step.

The desizing process as used herein is the same process as mentioned above in the context.

After desizing, the dyed fabric undergoes a biostoning step. The biostoning step can be performed with enzymes or pumice stones or both. As used herein, the term "biostoning", "stone washing" and "abrasion" are interchangeable, which means agitating the denim in an aqueous medium containing a mechanical abrasion agent such as pumice, an abrading cellulase or a combination of these, to provide a "stone-washed" look (i.e. a localized variation of colour density in the denim surface). In all cases, mechanical action is needed to remove the dye, and the treatment is usually carried out in washing machines, like drum washers, belly washers. As a result of uneven dye removal there are contrasts between dyed areas and areas from which dye has been removed, this appears as a localized variation of colour density. Treatment with cellulase can completely replace treatment with pumice stones. However, cellulase treatment can also be combined with pumice stone treatment, when it is desired to produce a heavily abraded finish.

For the purpose of the present invention, abrasion level is used to indicate the localized variation of colour density, which is measured under condition as specified in Example 4, by treatment with polypeptide of the present invention in Launder-O-Meter (LOM) at 30° C., pH 6.5 for 2 hour, with enzyme dosage of 0.05 mg/g fabric. In a preferred embodiment of the present invention, the endoglucanse having abrasion effect shows at least 0.5 Delta L* unit, preferably at least 1, more preferably at least 1.2, more preferably at least 1.3, more preferably at least 1.5, more preferably at least 1.6, more preferably at least 1.7, more preferably at least 1.8, more preferably at least 1.9, more preferably at least 2, more preferably at least 2.1, more preferably at least 2.2, more preferably at least 2.3, more preferably at least 2.4, more preferably at least 2.5, more preferably at least 2.6, even more preferably at least 2.7, even most preferably at least 2.8 Delta L* unit. Delta L* unit is defined in the material and method section under colour measurement.

The dyestuff removed from the denim material after the treatment with cellulase or by a conventional washing process may cause "backstaining" or "redeposition" of indigo onto the denim material, e.g. re-colouration of the blue threads and blue coloration of the white threads, resulting in a less contrast between the blue and white threads. In general, the higher abrasion level will lead to higher backstaining level as more dyestuff is removed and redeposited into the fabric. The process which causes high abrasion level but low backstaining level is desirable for the textile manufacture. To measure whether a process can achieve low backstaining level, the delta L* unit from one process shall be compared with a control process when both process reach the similar abrasion level (i.e. similar Delta L* unit), because the similar abrasion level general means similar amount of dyestuff removed by the process.

For the purpose of the present invention, low backstaining level is measured under condition as specified in Example 4, by treatment with polypeptide of the present invention in LOM at 30° C., pH 6.5 for 2 hour, with enzyme dosage of 0.025-0.1 mg/g fabric to achieve an equivalent abrasion level represented by delta L* on the textile surface, when compared with the results from using the control enzyme of mature polypeptide of Tt Cel45a (CBM+) as in Example 4. Curves shall be drawn with horizontal coordinate as Delta L* unit and vertical coordinate as Delta b* unit for the data obtained in the presention invention and the control process respectively. The backstaining level (Delta b*) of the present invention shall be compared with that of the control process under the same Delta L* unit in the curves. In a preferred embodiment of the present invention, to obtain same abrasion level on the textile surface, the endoglucanse having low backstaining effect shows at least 0.1 Delta b* unit increase, preferably at least 0.2, more preferably at least 0.3, even more preferably at least 0.4 Delta b* unit increase, when compared with the result from using control enzyme of mature polypeptide of Tt Cel45a (CBM+) as in Example 4. Delta b* unit is defined in the material and method part of the present invention.

Abrasion is generally followed by the third step, after-treatment which generally includes washing and rinsing steps during which detergents, optical brighteners, bleaching agents or softeners may be used.

The method for manufacturing textile of the present invention, by treating textile with an isolated polypeptide having endoglucanase activity but without a functional CBM as defined in the present invention can be applied to a biostoning process.

In one embodiment, the invention provides a method for introducing into the surface of dyed fabric or garment, localized variations in colour density in which the method comprises the step of contacting the fabric or garment with a polypeptide having endoglucanase activity as defined in the present invention. Preferably, the dyed fabric or garment is cellulosic or cellulose-containing fabric or garment. More preferably, the dyed fabric is a denim fabric, even more preferably, indigo dyed denim fabric.

In another embodiment, the invention provides a denim manufacturing process, which comprises: a) desizing of the denim fabric; b) biostoning the denim with a polypeptide having endoglucanase activity but without a functional CBM; c) rinsing.

The process of the invention may be carried out at conventional conditions in a washing machine conventionally used for stone-washing, e.g., a washer-extractor, belly washer, etc. The enzyme of the invention should be added in an effective amount.

Enzyme Composition for Textile

The present invention further relates to enzyme composition for textile comprising one or more polypeptide as defined in the presention invention.

The textile composition may be adapted for specific uses, such as biostoning or biopolishing, which can provide at least one of the textile benefits as reduced pilling formation, reduced weight loss of fabric, increased abrasion effect, and low backstaining level.

The textile composition may further include one or more of the enzymes selected from the group consisting of cellulase, proteases, lipases, cutinases, amylases, pectinases, hemicellulases, oxidoreductases, peroxidases, laccases, and transferases.

The textile composition typically comprises conventional ingredients including without limitation other enzymes, as well as surfactants, stabilizer, wetting agent, dispersing agents, antifoaming agents, lubricants, builder systems, and the like, or a mixture thereof, that provide superior effects related to, e.g., strength, resistance to pilling, water absorbency, and dyeability.

The textile composition can be in any form, such as a solid, liquid, paste, gel or any combination thereof.

Process Conditions

Preferably, in the present invention, the method of treating textile with an isolated polypeptide having endoglucanase activity but without a functional CBM is applied in a biostoning or a biopolishing process. All process conditions below are applicable for both biotoning process and biopolishing process.

It is at present advised that a suitable liquor/textile ratio to be used in the present method may be in the range of from about 20:1 to about 1:1, preferably in the range of from about 15:1 to about 3:1, more preferably in the range of from 15:1 to 5:1 (Volumn/weight, ml/mg).

In conventional "biostoning" or "biopolishing" processes, the reaction time is usually in the range of from about 10 minutes to about 8 hours. Preferably the reaction time is within the range of from about 20 minutes to about 180 minutes, more preferably the reaction time is within the range of from about 30 minutes to about 120 minutes.

The pH of the reaction medium greatly depends on the enzyme(s) in question. Preferably the process of the invention is carried out at a pH in the range of from about pH 3 to about pH 11, preferably in the range of from about pH 4 to about pH 8, or within the range of from about pH 4.5 to about pH 7.5.

The process of the present invention is able to function at a temperature below 90° C., preferably below 75° C., more preferably below 65° C., more preferably below 50° C., more preferably below 40° C., even more preferably below 30° C.

In some embodiments, the process of the present invention is conducted at the temperature range of 5-90° C., preferably 10-80° C., more preferably 10-75° C., more preferably 15-65° C., more preferably 20-50° C., more preferably 20-40° C., and even more preferably 20-30° C.

Enzyme dosage greatly depends on the enzyme reaction time and enzyme activity, i.e. a relatively short enzymatic reaction time or low enzymatic activity necessitates a relatively increased enzyme dosage, and vice versa. In general, enzyme dosage may be stipulated in accordance with the reaction time available.

The amount of polypeptide with endoglucanse activity but without a functional CBM to be used according to the method of the present invention depends on many factors. According to the invention the concentration of the polypeptide of the present invention in the aqueous medium may be from about 0.001 to about 10 milligram (mg) enzyme protein per gram (g) of fabric, preferably 0.02-5 milligram of enzyme protein per gram of fabric, more preferably 0.05-2 milligram of enzyme protein per gram of fabric.

The method of the present invention can provide the textile benefits of increased abrasion effect and/or low backstaining level during biostoning process.

The method of the present invention can provide the textile benefits of low pilling formation but without substantial weight loss of fabric during in the presence of anionic surfactant, during a biopolishing process.

EXAMPLES

Materials & Methods

Novoprime A 868® (a mono-component *Humicola insolens* GH45 endoglucanase product with CBM truncated, commercially available from Novozymes A/S)

| Polypeptide Name | Description | Protein sequence | DNA sequence |
|---|---|---|---|
| Tt Cel45a(CBM+) | Endoglucanase containing functional CBM: glutamine (Q) in wild-type *Thielavia terrestris* endoglucanse is substituted with histidine (H) in position corresponding to position 141 of SEQ ID NO: 2 | SEQ ID NO: 4 | SEQ ID NO: 3 |
| Tt Cel45a(CBM−) | Endoglucanase without functional CBM: SEQ ID NO: 4 with CBM truncated | SEQ ID NO: 2 | SEQ ID NO: 1 |

Colour Measurement

The abrasion level and backstaining level of the denim samples were determined by measuring the reflectance with pre-calibrated DataColor SF450X, alternatively an equivalent apparatus can be used. Four readings were taken for each sample, and the average of the readings were used. The abrasion level was evaluated with the index CIE L* on the blue side (front side) of the sample, and the backstaining level was evaluated with the index CIE b* on the back side of the sample.

L* indicates the change in white/black on a scale from 0 to 100, and a decrease in L* means an increase in black colour (decrease in white colour) and an increase in L* means an increase in white colour (decrease in black colour). Delta L* unit=L* of the swatch treated with a certain cellulase−L* of the swatch before cellulase treatment. The larger the Delta L* unit is the higher is the denim abrasion level, e.g. a Delta L* unit of 4 has higher abrasion level than Delta L*unit of 3.

b* indicates the change in blue/yellow, and a decrease in b* means an increase in blue colour (decrease in yellow colour), and an increase in b* means an increase in yellow colour (decrease in blue colour). Delta b* units=b* of the swatch treated with a certain cellulase−b* of the swatch before cellulase treatment. A larger Delta b* unit corresponds to a lower backstaining level, e.g. a Delta b* unit of −1.5 has lower backstaining level than the Delta b* unit of −2.5.

Weight Loss Determination

The swatches were placed in the conditioned room (65%+/−5% humidity, 20+/−1° C.) for 24 hours before they were numbered, weighed by the analytical balance (for samples below 100 g) or a precision balance (for samples over 100 g) and recorded. After treatment, all samples were tumbled dried (AEG, LAVATHERM 37700, Germany) for 1 hr and conditioned for 24 hr in conditioned room same as above. For each sample, the weight loss was defined as below:

$$\text{Weight loss}=(\text{weight before treatment}-\text{weight after treatment})/\text{weight before treatment}\times(100\%)$$

Pilling Notes Test

Fabrics including treated and untreated which had been pre-conditioned in norm climate (65% humidity, 20° C.) for at least 24 hours were tested for the pilling notes with Nu-Martindale Tester (James H. Heal Co. Ltd, England), with untreated fabrics of the same type as the abraded fabrics. A standard pilling test (Swiss Norm (SN) 198525) was carried out after 2000 Revolutions by marking from 1-5, with the meaning defined as below, where 1 shows poor anti-pilling and 5 shows excellent anti-pilling property. Thus the higher the Martindale pilling notes score the more effective the endoglucanase biopolishing treatment.

Note 5: No pilling
Note 4: Slight Pilling
Note 3: Moderate Pilling
Note 2: Distinct Pilling
Note 1: Heavy Pilling
1/2, 1/4 notes are allowed To make the test result more reliable, 3 separate readings were carried out by different persons for each sample, and the average of the 3 readings was adopted as the final result of pilling notes.

Protein Content

The enzyme protein in an enzyme product can be measured with BCA™ Protein Assay Kit (product number 23225, commercial available from Thermo Fisher Scientific Inc.) according to the product manual.

Example 1

Cloning of the Tt Cel45a(CBM+) and Tt Cel45a(CBM−) Gene from Genomic DNA

The wild type GH45 endoglucanase gene was cloned from the genomic DNA of Thielavia terrestris NRRL 8126 as described in Example 1A of WO 96/29397 (hereby incorporated by reference).

*Thielavia terristris* was grown in PDA agar plate at 37° C. for 4-5 days. Mycelia were collected directly from the agar plate into a sterilized mortar and frozen under liquid nitrogen. Frozen mycelia were ground, by mortar and pestle, to a fine powder, and genomic DNA was isolated using a DNeasy® Plant Mini Kit (QIAGEN Inc., Valencia, Calif., USA).

Then mutation was made according to Example 1 of WO98/12307 (hereby incorporated by reference), wherein glutamine (Q) was substituted with histidine (H) in position 119 according to *Thielavia terristris* cellulase sequence (e) in Table 1 of WO98/12307. This mutation corresponds to Q141H in SEQ ID NO: 2 of the present invention. The PCR fragment was ligated into pGEM-T (Promega Corporation, Madison, Wis., USA). And this resulted in a plasmid DNA, designated as Plasmid1.

Oligonucleotide primers, sense primer1 and antisense primer1, were designed to amplify the Tt Cel45a(CBM+) while sense primer1 and antisense primer2 were to amplify Tt Cel45a(CBM−) gene. An In-fusion CF Dry-down Cloning Kit (Clontech Laboratories, Inc., Mountain View, Calif., USA) was used to clone the fragment directly into the expression vector pPFJO355, without the need for restriction digestion and ligation.

```
Sense primer1 (SEQ ID NO: 5):
5' acacaactggggatcC ACC atgcgctctactcccgttcttc 3'

Antisense primer1 (SEQ ID NO: 6):
5' GTCACCCTCTAGATCT GACGAAGTTGACGGT

CTCCTTG 3'

Antisense primer2 (SEQ ID NO: 7):
5' GTCACCCTCTAGATCT CACCTCGTGCGAAAA

GCTGTTTAGA 3'
```

The underlined bold letters represented the coding sequence (sense primer1 and anti-sense primer2) or the downstream sequence of the coding region (antisense primer2). Stop codons were to be included in the resulted clones. The remaining sequences were identical to the insertion sites of pPFJO355.

The expression vector pPFJO355 contained the TAKA-amylase promoter derived from *Aspergillus oryzae* and the *Aspergillus niger* glucoamylase terminator elements. Furthermore pPFJO355 had pUC18 derived sequences for selection and propagation in *E. coli*, and a pyrG gene, which encoded an orotidine decarboxylase derived from *Aspergillus nidulans* for selection of a transformant of a pyrG mutant *Aspergillus* strain.

For Tt Cel45a(CBM−) Gene:

Twenty picomoles of each of Sense primer1 and Antisense primer2 were used in a PCR reaction composed of plasmid DNA Plasmid1, 10 μl of 5×GC Buffer, 1.5 ul of DMSO, 1.5 ul of 10 mM dNTP and 0.6 unit of Phusion™ High-Fidelity DNA Polymerase (Finnzymes Oy, Espoo, Finland) in a final volume of 50 μl. The amplification was performed using a Peltier Thermal Cycler (M J Research Inc., South San Francisco, Calif., USA) programmed for denaturing at 98° C. for 1 minute; 8 cycles of denaturing at 98° C. for 15 seconds, annealing at 68° C. for 30 seconds, with 1° C. increasing per cycle and elongation at 72° C. for 75 seconds; and another 22 cycles each at 98° C. for 15 seconds, 65 C for 30 seconds and 72° C. for 75 seconds; final extension at 72° C. for 5 minutes. The heat block then went to a 4° C. soak cycle.

The reaction products were isolated by 1.0% agarose gel electrophoresis using 90 mM Tris-borate and 1 mM EDTA (TBE) buffer where a ~0.8 kb product band was excised from the gel, and purified using an illustra GFX PCR DNA and Gel Band Purification Kit (GE Healthcare, Buckinghamshire, UK) according to the manufacturer's instructions.

For Tt Cel45a(CBM+) Gene:

Twenty picomoles of Sense primer1 and Antisense primer1 were used in a PCR reaction composed of plasmid DNA Plasmid1, 10 μl of 5×GC Buffer, 1.5 ul of DMSO, 1 ul of 10 mM dNTP and 0.6 unit of Phusion™ High-Fidelity DNA Polymerase (Finnzymes Oy, Espoo, Finland) in a final volume of 50 μl. The amplification was performed using a Peltier Thermal Cycler (M J Research Inc., South San Francisco, Calif., USA) programmed for denaturing at 98° C. for 40 seconds; 8 cycles of denaturing at 98° C. for 15 seconds, annealing at 70° C. for 30 seconds, with 1° C. increasing per cycle and elongation at 72° C. for 80 seconds; and another 23 cycles each at 98° C. for 15 seconds, 62° C. for 30 seconds and 72° C. for 80 seconds; final extension at 72° C. for 5 minutes. The heat block then went to a 4° C. soak cycle.

The reaction products were isolated by 1.0% agarose gel electrophoresis using 90 mM Tris-borate and 1 mM EDTA (TBE) buffer where a 1.0 kb product band was excised from the gel, and purified using an illustra GFX PCR DNA and Gel Band Purification Kit (GE Healthcare, Buckinghamshire, UK) according to the manufacturer's instructions.

Plasmid pPFJO355 was digested with Bam I and Bgl II, isolated by 1.0% agarose gel electrophoresis using TBE buffer, and purified using an illustra GFX PCR DNA and Gel Band Purification Kit according to the manufacturer's instructions.

Figure 2:
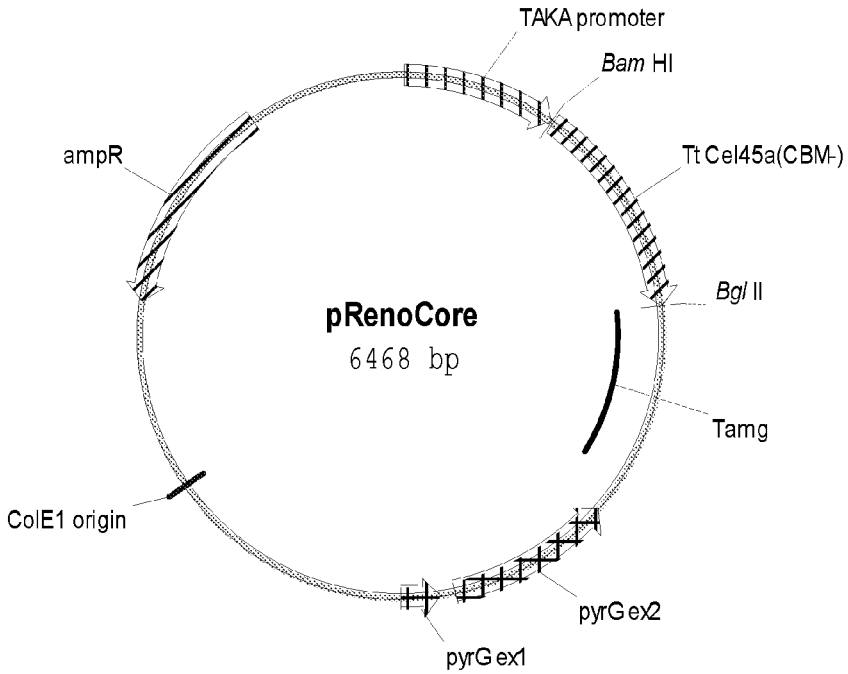
FIG. 2 shows a restriction map of pRenoCore.

The gene fragments, Tt Cel45a(CBM+) or Tt Cel45a (CBM−), and the digested vector were ligated together using an In-fusion CF Dry-down PCR Cloning resulting in pRenoCBD and pRenoCore (FIGS. 1 and 2, reactively). The transcription of the Tt Cel45a(CBM+) and Tt Cel45a(CBM−) genes were under the control of a TAKA-amylase promoter from the gene for *Aspergillus oryzae* alpha-amylase. The cloning operation was performed according to the manufacturer's instruction. In brief, 30 ng of pPFJO355 digested with Bam I and Bgl II, and 100 ng of the Tt Cel45a(CBM+) or Tt Cel45a(CBM−) genes purified PCR products were added to the reaction vials and resuspended the powder in a final volume of 10 ul with addition of deionized water. Reactions were incubated at 37° C. for 15 minutes and then 50° C. for 15 minutes. Three μl of the reactions were used to transform *E. coli* TOP10 competent cells (TIANGEN Biotech (Beijing) Co. Ltd., Beijing, China). *E. coli* transformants containing pRenoCBD or pRenoCore were detected by colony PCRs and plasmid DNA was prepared using a QIAprep Spin Miniprep Kit (QIAGEN Inc., Valencia, Calif., USA). The Tt Cel45a (CBM+) gene inserted in pRenoCBD and Tt Cel45a(CBM−) inserted in pRenoCore were confirmed by DNA sequencing using 3730XL DNA Analyzers (Applied Biosystems Inc, Foster City, Calif., USA). The genomic DNA sequences of Tt Cel45a(CBM−) and Tt Cel45a(CBM+) genes were shown as SEQ ID NO: 1 and 3 respectively. The deduced protein sequences of Cel45a(CBM−) genes was shown as SEQ ID NO: 2, wherein amino acids 1-21 constitute the signal peptide and amino acids 22-237 constitute the mature polypeptide of the catalytic module. The deduced protein sequences of Cel45a(CBM+) genes was shown in SEQ ID NO: 4, wherein amino acids 1-21 constitute the signal peptide and amino acids 22-299 constitute the mature polypeptide with catalytic module, linker (amino acids 238-261) and CBM (amino acids 262-299).

Example 2

Expression of Tt Cel45a(CBM+) and Tt Cel45a(CBM−) Genes in *Aspergillus oryzae*

*Aspergillus oryzae* HowB101 (described in WO9535385 example 1, hereby incorporated by reference) protoplasts were prepared according to the method described in Christensen et al., 1988, *Bio/Technology* 6: 1419-1422. Three μg of pRenoCBD or pRenoCore were used to transform *Aspergillus oryzae* HowB101.

The transformation of *Aspergillus oryzae* HowB101 with pRenoCBD or pRenoCore both yielded about 50 transformants. Four transformants were isolated to individual Minimal medium plates.

Four transformants were inoculated separately into 3 ml of YPM medium (1% of Yeast extract, 2% of Peptone and 2% of Maltose) in 24-well plate and incubated at 30° C., 150 rpm. After 3 days incubation, 20 μl of supernatant from each culture were analyzed on NuPAGE Novex 4-12% Bis-Tris Gel w/MES (Invitrogen Corporation, Carlsbad, Calif., USA) according to the manufacturer's instructions. The resulting gel was stained with Instant Blue (Expedeon Ltd., Babraham Cambridge, UK). SDS-PAGE profiles of the cultures showed that the majority of the transformants had a major band of approximately 38 kDa for Tt Cel45a(CBM+) and 25 kDa for Tt Cel45a(CBM−). The expression strains were designated as Strain-1 and Strain-2, respectively.

A slant culture of one transformant, designated transformant-2 of Strain-1 and a slant culture of one transformant, also designated transformant-2 of Strain-2, were each washed with 10 ml of YPM and inoculated separately into 8 flasks of 2-liter, each containing 400 ml of YPM medium, to generate broth for characterization of the enzyme. The culture was harvested on day 3 by filtering the culture against MIRACLOTH® (CALBIOCHEM, Inc. La Jolla, Calif., USA). The filtered culture broth was then again filtered using a 0.45 μm DURAPORE Membrane (Millipore, Bedford, Mass., USA).

Example 3

Purification of Mature Polypeptides of Tt Cel45a(CBM+) and Tt Cel45a(CBM−)

3000 ml supernatant of the transformant-2 of Strain-1 as described in Example 2 was precipitated with ammonium sulfate (80% saturation) and re-dissolved in 100 ml 25 mM Tris-HCl buffer, pH7.0, then dialyzed against the same buffer and filtered through a 0.45 mm filter, the final volume was 200 ml. The solution was applied to a 50 ml Q FF column (Pharmacia) equilibrated in 25 mM Tris-HCl buffer, pH7.0, and the proteins were eluted with a linear NaCl gradient (0-0.4M). Fractions with activity against AZCL-beta-glucan (substrate for endoglucanse, available from Megazyme) were pooled. Then the pooled solution was concentrated by ultra filtration. The purified mature polypeptide of Tt Cel45a(CBM+) was at least 95% pure judged by SDS-PAGE analysis.

3000 ml supernatant of the transformant-2 of Strain-2 as described in Example 2 was precipitated with ammonium sulfate (80% saturation) and re-dissolved in 100 ml 25 mM Tris-HCl buffer, pH7.0, then dialyzed against the same buffer and filtered through a 0.45 mm filter, the final volume was 200 ml. The solution was applied to a 40 ml Q FF column (Phamacia) equilibrated in 25 mM Tris-HCl buffer, pH7.0, and the proteins were eluted with a linear NaCl gradient (0-0.4M). Only the proteins showed activity toward AZCL-beta-glucan (Megazyme) was concentrated by ultra filtration, and applied to a S-100 column (Phamacia) equilibrated in 25 mM Tris-HCl buffer, pH7.0. Fractions with activity against AZCL-beta-glucan (Megazyme) were pooled. Then the pooled solution was concentrated by ultra filtration. The purified mature polypeptide of Tt Cel45a(CBM−) were at least 95% pure judged by SDS-PAGE analysis.

Example 4

Denim Abrasion with Mature Polypeptides of Tt Cel45a(CBM+) and Tt Cel45a (CBM−) in Launder-O-Meter Mature polypeptides of Tt Cel45a(CBM+) (i.e. amino acids 22-299 of SEQ ID NO: 4) and Tt Cel45a(CBM−) (i.e. amino acids 22-237 of SEQ ID NO:2) obtained in Example 3 were tested in Launder-O-Meter (LOM, SDL-Atlas LP2) at two temperatures 30° C. and 50° C. Abrasion level and backstaining level were compared.

Raw denim was desized and cut to 12.5 cm tall and 23 cm long. The denim was cut and sewn, forming a tube with height of 12.5 cm and weight of about 14 g. The tubes were placed in a conditioned room (65% relative humidity, 20° C.) for 24 hours before they were numbered, weighed by the analytical balance and recorded. One conditioned tube was placed in each 500 ml beaker, with the blue side facing inward. For each beaker, 30 big nuts (M10 M6M-SR-A4-80, acid proof), 10 small nuts (M6 M6M-SR-A4-80, acid proof), 7 big star magnets (diameter of 17 mm, item no. 3-CO-411117, Cowie, Schweiz via Bie & Berntsen), and 3 small star magnets (diameter. 14 mm, item no. 3-CO-11117, Cowie, Schweiz via Bie & Berntsen) were used to supply the mechanical aids. Then the buffer (50 mM phosphate buffer, pH 6.5) and the enzyme solutions were added according to Table 1, based on the calculation of actual fabric weights, to make a total volume around 50 ml, which would create a liquid to fabric ratio of about 3.8:1 (v/w ml/g).

Meanwhile, the Launder-O-Meter (LOM) machine was started after the required program was chosen, and it would hold when the temperature reached the pre-set temperature (30° C. or 50° C.). Each beaker was fitted with a lid lined with 2 neoprin gaskets and closed tightly with the metal clamping device. The beakers were loaded into the preheated LOM. Metal racks were used to accommodate and secure 6 beakers, in the horizontal position, in each of the 4 drum positions. The LOM lid was closed and the washing program was continued and the timing was initiated. 2 hours later, all beakers were removed and the denim samples were transferred to the inactivation solution (2 g/L sodium carbonate) at 85° C. for 10 minutes. Then the swatches were rinsed in hot water for 2 times and in cold water for 2 times. The denim samples were tumble-dried (AEG, LAVATHERM 37700, Germany) and then conditioned for 24 hours at 20° C., 65% relative humidity prior to evaluation.

The abrasion and backstaining level of the denim samples were determined by measuring the reflectance before and after endoglucanse treatment with pre-calibrated DataColor SF450X. For both L* and b*, four readings were conducted for each fabric and the average of the four readings was used.

The abrasion level was reflected by the changes in the index CIE L* of the blue side of the sample, and the backstaining level was reflected by the changes in the index CIE b* of the back of the sample.

As shown in Table 1, Tt Cel45a(CBM−), endoglucanase without CBM, showed higher denim abrasion level of delta L* than the CBM containing endoglucanase of Tt Cel45a (CBM+) when the same amount of proteins were loaded. And the performance difference became more substantial when the comparison was done at a lower temperature, 30° C.

Tt Cel45a(CBM−) also showed advantage in term of less backstaining on equivalent abrasion level, as shown in Table 1. For example, when the use of Tt Cel45a(CBM+) at 50° C. reaches the delta L* of 4.7, and the use of Tt Cel45a(CBM−) at 50° C. reaches the delta L* of 5.3, the use of Tt Cel45a (CBM−) shows lower backstaining level of −2.3 than that of Tt Cel45a(CBM+) of −2.9. The conclusion will be even more obvious if the curves are drawn with horizontal coordinate as Delta L* unit and vertical coordinate as Delta b* unit for the data obtained in Table 1, that is, Tt Cel45a(CBM−) shows lower backstaining level than that of Tt Cel45a(CBM+) in the same abrasion level.

TABLE 1

Denim abrasion in LOM at pH 6.5 for 2 hours

| Enzyme | Temperature (° C.) | Dosage (mg protein/g fabric) | delta L* | delta b* |
|---|---|---|---|---|
| Mature poly-peptides of Tt Cel45a(CBM+) | 50 | 0.025 | 2.6 | −2.3 |
| | | 0.05 | 3.7 | −2.4 |
| | | 0.1 | 4.7 | −2.9 |
| | 30 | 0.025 | 1.3 | −1.9 |
| | | 0.05 | 1.3 | −1.5 |
| | | 0.1 | 2.2 | −2.3 |
| Mature poly-peptides of Tt Cel45a(CBM−) | 50 | 0.05 | 4.1 | −2.3 |
| | | 0.1 | 5.3 | −2.3 |
| | | 0.2 | 6.3 | −2.8 |
| | 30 | 0.05 | 2.8 | −1.9 |
| | | 0.1 | 3.8 | −2.4 |
| | | 0.2 | 4.9 | −2.4 |

Example 5

Bio-Polishing with Mature Polypeptides of Tt Cel45a(CBM−) and Hi Cel45a (CBM−) in LOM Biopolishing trials were conducted in Launder-O-Meter for the CBM truncated molecules of mature polypeptide of Tt Cel45a(CBM−) and Novoprime A 868® (a mono-component Humicola insolens GH45 endoglucanase product with CBM truncated) with different amount of LAS (Linear Alkylbenzene Sulfonates), an anionic surfactant which was widely used in textile, detergent, etc.

Knitted 100% cotton interlock fabric, was cut into 16.5 cm* 16.5 cm, as the standard swatches. The swatches were placed in the conditioned room (65% humidity, 20° C.) for 24 hours before they were numbered, weighed by the analytical balance and recorded. Two conditioned swatches were placed in each 500 ml beaker. For each beaker, 20 big steel balls (total weight of 220 g) in each beaker were used to supply the mechanical aids. Then the buffer (50 mM phosphate buffer, pH 6.5) was added based on the calculation of enzyme solutions, the total volume was around 100 ml, which would create a liquid to fabric ratio of about 10:1 (v/w).

The LOM machine was started after the required program was chosen, and it would hold when the temperature reached 55° C. In order to compare the weight loss under the similar pilling notes, Tt Cel45a(CBM−) and enzyme protein from Novoprime A 868® are added at different dosage to reach the similar pilling notes. Together with 63 mg/L Tt Cel45a (CBM−) or 21 mg/L enzyme protein in Novoprime A 868®, different amounts of LAS were loaded into each beaker according to Table 2. The beakers were sealed up and placed in the LOM, and the enzymatic treatment was started in LOM for 1 hour. When time was up, all beakers were removed and the swatches were transferred to the inactivation solution (2 g/L sodium carbonate) at 85° C. for 10 minutes. Then the swatches were rinsed in hot water for 2 times and in cold water for 2 times. These samples were Tumble-dried, and then conditioned for 24 hours at 20° C., 65% relative humidity prior to evaluation.

As shown in Table 2, Tt Cel45a(CBM−) exhibited a much better compatibility with LAS than the counterpart from Novoprime A 868(r): Tt Cel45a(CBM−) retained its original performance at the presence of 0.5 g/L LAS (in term of weight loss performance) or as high as 0.8 g/L LAS (in term of pilling notes). The enzyme from Novoprime A 868® significantly lost its performance if the LAS concentration was 0.5 g/L or higher, as the drop of weight loss at 0.5 g/l LAS concentration implied the deactivation of the enzyme. Tt Cel45a(CBM−) also shows advantage in term of less weight loss on equivalent anti-pilling effect: for example, when reaching the pilling note of 4.4, Tt Cel45a(CBM−) results in the weight loss of 2.8% while Novoprime A 868® resulted in the weight loss of 3.1%.

The enzyme protein in Novoprime A 868® can be measured by BCA™ Protein Assay Kit.

TABLE 2

Biopolishing in LOM with different amounts of LAS at pH 6.5, 55° C. for 1 hour

| Enzyme | Enzyme dosage (mg protein/g fabric) | LAS concentration (g/L) | Weight loss | Pilling notes |
|---|---|---|---|---|
| Mature poly-peptides of Tt Cel45a(CBM−) | 0.63 | 0 | 2.6% | 3.8 |
| | 0.63 | 0.2 | 2.7% | 4.0 |
| | 0.63 | 0.5 | 2.8% | 4.4 |
| | 0.63 | 0.8 | 1.8% | 3.9 |
| Enzyme protein from Novoprime A 868 ® | 0.21 | 0 | 3.4% | 4.1 |
| | 0.21 | 0.2 | 3.1% | 4.4 |
| | 0.21 | 0.5 | 0.7% | 2.8 |
| | 0.21 | 0.8 | −0.4% | 2.6 |

Example 6

Identification of Functional CBM

The following method is used to measure the functional CBM of a polypeptide, in order to identify a polypeptide having endoglucanase activity but lacking a functional CBM.

200 microliter of enzyme solution (enzyme concentration at about 1 mg/ml, sample 01) was mixed with 200 microliter of 10% Avicel (Remazol-dyed Avicel, Sigmacell type 20) suspension, which is made up in 0.1 M Tris buffer, pH 7.5, and mixed for 15 minutes using 1.5 ml Eppendorf tubes. The mixture was left for 1 hour incubation at 4° C. After incubation, the binding of the enzyme to Avicel can be detected by spinning the Avicel for 5 minutes at 5000 rpm at room temperature in an Eppendorf centrifuge, and the supernatant was kept as sample S1. The protein content was tested for both samples O1 and S1 with BCA kit. The enzyme absorption was defined as below:

Absorption=(O1−S1×2)/O1×(100%).

O1: the protein concentration of sample O1 tested by BCA kit

S1: the protein concentration of sample S1 tested by BCA kit

Polypeptides without a functional CBM showed absorption of no more than 15% as defined above.

All patents, patent applications, and literature references referred to herein are hereby incorporated by reference in their entirety. Many variations of the present invention will suggest themselves to those skilled in the art in light of the above detailed description. Such obvious variations are within the full intended scope of the appended claims.

SEQUENCE LISTING

```
<160> NUMBER OF SEQ ID NOS: 7

<210> SEQ ID NO 1
<211> LENGTH: 858
<212> TYPE: DNA
<213> ORGANISM: Thielavia terrestris
<220> FEATURE:
<221> NAME/KEY: Intron
<222> LOCATION: (90)..(167)
<220> FEATURE:
<221> NAME/KEY: Intron
<222> LOCATION: (417)..(485)

<400> SEQUENCE: 1

atgcgctcta ctcccgttct tcgcacaacc ctggccgctg cacttcctct ggtcgcctcc     60

gcggccagtg gcagtggcca gtccacgagg tatgcgtccc tcaatgcgaa tgcctcacca    120

aacgagctag gtgtccagga cgccgcccat gctgactcgt ttcccagata ctgggactgc    180

tgcaagccgt cgtgcgcttg gcccgggaag gccgccgtca gccaaccggt ctacgcgtgc    240

gatgccaact tccagcgcct gtccgacttc aatgtccagt cgggctgcaa cggcggctcg    300

gcctactcct gcgccgacca gactccctgg gcggtgaacg acaatctcgc ctacggcttc    360

gccgcgacga gcatcgccgg cgggtccgaa tcctcgtggt gctgcgcctg ctacgcgtaa    420

gtcctctctg ccagctacca ggaagttgga ttagcgcgag ctaacctcac tccatcacac    480

tccaggctca ccttcacttc cggtcccgtc gccggcaaga caatggtggt gcagtcaacg    540

agcactggcg gcgacctggg aagtaaccat ttcgatatcg ccatgcccgg cggcggcgtg    600

ggcatcttca acggctgcag ctcgcagttc ggcggcctcc ccggcgctca atacggcggc    660

atttcgtcgc gcgaccagtg cgattccttc cccgcgccgc tcaagcccgg ctgccagtgg    720

cggtttgact ggttccagaa cgccgacaac ccgacgttca cgttccagca ggtgcagtgc    780

cccgccgaga tcgttgcccg ctccggctgc aagcgcaacg acgactccag cttccccgtc    840

ttcacccccc caagcggt                                                  858


<210> SEQ ID NO 2
<211> LENGTH: 237
<212> TYPE: PRT
<213> ORGANISM: Thielavia terrestris
<220> FEATURE:
<221> NAME/KEY: VARIANT
<222> LOCATION: (1)..(237)
<220> FEATURE:
<221> NAME/KEY: SIGNAL
<222> LOCATION: (1)..(21)

<400> SEQUENCE: 2

Met Arg Ser Thr Pro Val Leu Arg Thr Thr Leu Ala Ala Ala Leu Pro
1               5                   10                  15

Leu Val Ala Ser Ala Ala Ser Gly Ser Gly Gln Ser Thr Arg Tyr Trp
            20                  25                  30

Asp Cys Cys Lys Pro Ser Cys Ala Trp Pro Gly Lys Ala Ala Val Ser
        35                  40                  45

Gln Pro Val Tyr Ala Cys Asp Ala Asn Phe Gln Arg Leu Ser Asp Phe
```

```
    50                  55                  60

Asn Val Gln Ser Gly Cys Asn Gly Gly Ser Ala Tyr Ser Cys Ala Asp
65                  70                  75                  80

Gln Thr Pro Trp Ala Val Asn Asp Asn Leu Ala Tyr Gly Phe Ala Ala
                85                  90                  95

Thr Ser Ile Ala Gly Gly Ser Glu Ser Ser Trp Cys Cys Ala Cys Tyr
            100                 105                 110

Ala Leu Thr Phe Thr Ser Gly Pro Val Ala Gly Lys Thr Met Val Val
        115                 120                 125

Gln Ser Thr Ser Thr Gly Gly Asp Leu Gly Ser Asn His Phe Asp Ile
    130                 135                 140

Ala Met Pro Gly Gly Gly Val Gly Ile Phe Asn Gly Cys Ser Ser Gln
145                 150                 155                 160

Phe Gly Gly Leu Pro Gly Ala Gln Tyr Gly Gly Ile Ser Ser Arg Asp
                165                 170                 175

Gln Cys Asp Ser Phe Pro Ala Pro Leu Lys Pro Gly Cys Gln Trp Arg
            180                 185                 190

Phe Asp Trp Phe Gln Asn Ala Asp Asn Pro Thr Phe Thr Phe Gln Gln
        195                 200                 205

Val Gln Cys Pro Ala Glu Ile Val Ala Arg Ser Gly Cys Lys Arg Asn
    210                 215                 220

Asp Asp Ser Ser Phe Pro Val Phe Thr Pro Pro Ser Gly
225                 230                 235


<210> SEQ ID NO 3
<211> LENGTH: 1044
<212> TYPE: DNA
<213> ORGANISM: Thielavia terrestris
<220> FEATURE:
<221> NAME/KEY: Intron
<222> LOCATION: (90)..(167)
<220> FEATURE:
<221> NAME/KEY: Intron
<222> LOCATION: (417)..(485)

<400> SEQUENCE: 3

atgcgctcta ctcccgttct tcgcacaacc ctggccgctg cacttcctct ggtcgcctcc     60

gcggccagtg gcagtggcca gtccacgagg tatgcgtccc tcaatgcgaa tgcctcacca    120

aacgagctag gtgtccagga cgccgcccat gctgactcgt ttcccagata ctgggactgc    180

tgcaagccgt cgtgcgcttg gcccgggaag gccgccgtca gccaaccggt ctacgcgtgc    240

gatgccaact tccagcgcct gtccgacttc aatgtccagt cgggctgcaa cggcggctcg    300

gcctactcct gcgccgacca gactccctgg gcggtgaacg acaatctcgc ctacggcttc    360

gccgcgacga gcatcgccgg cgggtccgaa tcctcgtggt gctgcgcctg ctacgcgtaa    420

gtcctctctg ccagctacca ggaagttgga ttagcgcgag ctaacctcac tccatcacac    480

tccaggctca ccttcacttc cggtcccgtc gccggcaaga caatggtggt gcagtcaacg    540

agcactggcg gcgacctggg aagtaaccat ttcgatatcg ccatgcccgg cggcggcgtg    600

ggcatcttca acggctgcag ctcgcagttc ggcggcctcc ccggcgctca atacggcggc    660

atttcgtcgc gcgaccagtg cgattccttc cccgcgccgc tcaagcccgg ctgccagtgg    720

cggtttgact ggttccagaa cgccgacaac ccgacgttca cgttccagca ggtgcagtgc    780

cccgccgaga tcgttgcccg ctccggctgc aagcgcaacg acgactccag cttccccgtc    840

ttcacccccc caagcggtgg caacggtggc accgggacgc ccacgtcgac tgcgcctggg    900
```

```
tcgggccaga cgtctcccgg cggcggcagt ggctgcacgt ctcagaagtg ggctcagtgc    960

ggtggcatcg gcttcagcgg atgcaccacc tgtgtctctg gcaccacctg ccagaagttg   1020

aacgactact actcgcagtg cctc                                          1044


<210> SEQ ID NO 4
<211> LENGTH: 299
<212> TYPE: PRT
<213> ORGANISM: Thielavia terrestris
<220> FEATURE:
<221> NAME/KEY: VARIANT
<222> LOCATION: (1)..(299)
<220> FEATURE:
<221> NAME/KEY: SIGNAL
<222> LOCATION: (1)..(21)

<400> SEQUENCE: 4

Met Arg Ser Thr Pro Val Leu Arg Thr Thr Leu Ala Ala Ala Leu Pro
1               5                   10                  15

Leu Val Ala Ser Ala Ala Ser Gly Ser Gly Gln Ser Thr Arg Tyr Trp
            20                  25                  30

Asp Cys Cys Lys Pro Ser Cys Ala Trp Pro Gly Lys Ala Ala Val Ser
        35                  40                  45

Gln Pro Val Tyr Ala Cys Asp Ala Asn Phe Gln Arg Leu Ser Asp Phe
    50                  55                  60

Asn Val Gln Ser Gly Cys Asn Gly Gly Ser Ala Tyr Ser Cys Ala Asp
65                  70                  75                  80

Gln Thr Pro Trp Ala Val Asn Asp Asn Leu Ala Tyr Gly Phe Ala Ala
                85                  90                  95

Thr Ser Ile Ala Gly Gly Ser Glu Ser Ser Trp Cys Cys Ala Cys Tyr
            100                 105                 110

Ala Leu Thr Phe Thr Ser Gly Pro Val Ala Gly Lys Thr Met Val Val
        115                 120                 125

Gln Ser Thr Ser Thr Gly Gly Asp Leu Gly Ser Asn His Phe Asp Ile
    130                 135                 140

Ala Met Pro Gly Gly Gly Val Gly Ile Phe Asn Gly Cys Ser Ser Gln
145                 150                 155                 160

Phe Gly Gly Leu Pro Gly Ala Gln Tyr Gly Gly Ile Ser Ser Arg Asp
                165                 170                 175

Gln Cys Asp Ser Phe Pro Ala Pro Leu Lys Pro Gly Cys Gln Trp Arg
            180                 185                 190

Phe Asp Trp Phe Gln Asn Ala Asp Asn Pro Thr Phe Thr Phe Gln Gln
        195                 200                 205

Val Gln Cys Pro Ala Glu Ile Val Ala Arg Ser Gly Cys Lys Arg Asn
    210                 215                 220

Asp Asp Ser Ser Phe Pro Val Phe Thr Pro Pro Ser Gly Gly Asn Gly
225                 230                 235                 240

Gly Thr Gly Thr Pro Thr Ser Thr Ala Pro Gly Ser Gly Gln Thr Ser
                245                 250                 255

Pro Gly Gly Gly Ser Gly Cys Thr Ser Gln Lys Trp Ala Gln Cys Gly
            260                 265                 270

Gly Ile Gly Phe Ser Gly Cys Thr Thr Cys Val Ser Gly Thr Thr Cys
        275                 280                 285

Gln Lys Leu Asn Asp Tyr Tyr Ser Gln Cys Leu
    290                 295


<210> SEQ ID NO 5
```

-continued

```
<211> LENGTH: 41
<212> TYPE: DNA
<213> ORGANISM: Artificial sequence
<220> FEATURE:
<223> OTHER INFORMATION: Primer

<400> SEQUENCE: 5

acacaactgg ggatccacca tgcgctctac tcccgttctt c                        41


<210> SEQ ID NO 6
<211> LENGTH: 38
<212> TYPE: DNA
<213> ORGANISM: Artificial sequence
<220> FEATURE:
<223> OTHER INFORMATION: Primer

<400> SEQUENCE: 6

gtcaccctct agatctgacg aagttgacgg tctccttg                            38


<210> SEQ ID NO 7
<211> LENGTH: 41
<212> TYPE: DNA
<213> ORGANISM: Artificial sequence
<220> FEATURE:
<223> OTHER INFORMATION: Primer

<400> SEQUENCE: 7

gtcaccctct agatctcacc tcgtgcgaaa agctgtttag a                        41
```

The invention claimed is:

1. A method for treating a textile, comprising treating the textile with a polypeptide having endoglucanase activity, wherein the polypeptide has at least 95% sequence identity to the sequence of amino acids 22-237 of SEQ ID NO: 2 and does not comprise a functional cellulose binding domain.

2. The method of claim 1, wherein the polypeptide has at least 97% sequence identity to the sequence of amino acids 22-237 of SEQ ID NO: 2.

3. The method of claim 1, wherein the polypeptide has at least 99% sequence identity to the sequence of amino acids 22-237 of SEQ ID NO: 2.

4. The method of claim 1, wherein the polypeptide comprises the sequence of amino acids 22-237 of SEQ ID NO: 2.

5. The method of claim 1, wherein the polypeptide is encoded by a polynucleotide that hybridizes under high stringency conditions with (i) the mature polypeptide coding sequence of SEQ ID NO: 1, or (ii) the cDNA sequence contained in the mature polypeptide coding sequence of SEQ ID NO: 1, or (iii) the full-length complementary strand of (i) or (ii).

6. The method of claim 1, wherein the polypeptide is a variant of the polypeptide of SEQ ID NO: 2, which comprises a substitution, deletion and/or insertion at one or more positions.

7. The method of claim 6, wherein the polypeptide contains a histidine residue at a position corresponding to position 141 of SEQ ID NO: 2.

8. The method of claim 1, wherein the method is a biostoning process resulting in localized variation of color density in the surface the textile.

9. The method of claim 8, wherein the textile is dyed cellulosic or cellulose-containing fabric.

10. The method of claim 8, wherein the biostoning process achieves an abrasion level of at least 0.5 Delta L* unit.

11. The method of claim 8, wherein the biostoning process achieves a backstaining level of at least 0.1 Delta b* unit increase.

12. The method of claim 1, wherein the method is applied in a biopolishing process.

13. The method of claim 12, wherein the biopolishing process results in a pilling note of at least 3.

14. The method of claim 12, wherein the biopolishing process shows a weight loss of less than 10%.

15. The method of claim 1, wherein the method is conducted at a temperature below 90° C.

16. The method of claim 15, wherein the method is conducted at a temperature below 65° C.

17. The method of claim 16, wherein the method is conducted at a temperature below 40° C.

18. The method of claim 1, wherein the method is conducted at a pH in the range of 4.5 to 7.5.

19. The method of claim 1, wherein the polypeptide is applied in an amount in the range of 0.05-2 milligram of enzyme protein per gram of textile.

20. The method of claim 1, which further comprises treating the textile with one or more enzymes selected from the group consisting of proteases, lipases, cutinases, amylases, pectinases, hemicellulases and cellulases.

* * * * *